US007754061B2

(12) United States Patent
Basol

(10) Patent No.: US 7,754,061 B2
(45) Date of Patent: Jul. 13, 2010

(54) METHOD FOR CONTROLLING CONDUCTOR DEPOSITION ON PREDETERMINED PORTIONS OF A WAFER

(75) Inventor: Bulent M. Basol, Manhattan Beach, CA (US)

(73) Assignee: Novellus Systems, Inc., San Jose, CA (US)

( * ) Notice: Subject to any disclaimer, the term of this patent is extended or adjusted under 35 U.S.C. 154(b) by 1236 days.

(21) Appl. No.: 11/221,060

(22) Filed: Sep. 6, 2005

(65) Prior Publication Data

US 2007/0051635 A1 Mar. 8, 2007

Related U.S. Application Data

(63) Continuation-in-part of application No. 11/190,763, filed on Jul. 26, 2005, now Pat. No. 7,517,444, which is a continuation of application No. 09/961,193, filed on Sep. 20, 2001, now Pat. No. 6,921,551, which is a continuation-in-part of application No. 09/919,788, filed on Jul. 31, 2001, now Pat. No. 6,858,121, which is a continuation-in-part of application No. 09/740,701, filed on Dec. 18, 2000, now Pat. No. 6,534,116.

(60) Provisional application No. 60/224,739, filed on Aug. 10, 2000.

(51) Int. Cl.
*C25D 5/06* (2006.01)

(52) U.S. Cl. ..... 205/117; 205/93

(58) Field of Classification Search ..... 205/93, 205/117, 157, 170, 206
See application file for complete search history.

(56) References Cited

U.S. PATENT DOCUMENTS

| | | | |
|---|---|---|---|
| 2,540,602 | A | 2/1951 | Thomas et al. |
| 2,708,181 | A | 5/1955 | Holmes et al. |
| 2,965,556 | A | 12/1960 | Damgaard |
| 3,328,273 | A | 6/1967 | Creutz et al. |
| 3,448,023 | A | 6/1969 | Bell |
| 3,637,468 | A | 1/1972 | Icxi et al. |

(Continued)

FOREIGN PATENT DOCUMENTS

EP 1 037 263 B1 8/2004

(Continued)

OTHER PUBLICATIONS

U.S. Appl. No. 09/671,800, filed Sep. 28, 2000, Basol et al.

(Continued)

*Primary Examiner*—Nam X Nguyen
*Assistant Examiner*—Luan V Van
(74) *Attorney, Agent, or Firm*—Knobbe Martens Olson & Bear LLP

(57) ABSTRACT

A plating apparatus and method for deposition of a conductive material on a semiconductor wafer having surface portions and cavity portions. A differential in an adsorbed concentration of an additive, including accelerators or suppressors, between a surface portion and a cavity portion of a wafer surface is established in a chamber. A mask or sweeper may be used to establish the differential. After establishing the differential in the chamber, the conductive material is electrodeposited to form a conductive layer on the surface in another chamber.

42 Claims, 10 Drawing Sheets

U.S. PATENT DOCUMENTS 3,779,887 A 12/1973 Gildone
3,959,089 A 5/1976 Watts
4,391,684 A 7/1983 Goddard
4,430,173 A 2/1984 Boudot et al.
4,431,501 A 2/1984 Leppanen
4,466,864 A 8/1984 Bacon et al.
4,609,450 A 9/1986 Seimiya et al.
4,610,772 A 9/1986 Palnik
4,339,319 A 12/1987 Ting et al.
4,713,149 A 12/1987 Hoshino
4,948,474 A 8/1990 Miljkovic
4,954,142 A 9/1990 Carr et al.
4,975,159 A 12/1990 Dahms
5,024,735 A 6/1991 Kadija
5,084,071 A 1/1992 Nenadic et al.
5,171,412 A 12/1992 Talieh et al.
5,256,565 A 10/1993 Bernhardt et al.
5,292,399 A 3/1994 Lee et al.
5,354,490 A 10/1994 Yu et al.
5,429,733 A 7/1995 Ishida
5,466,161 A 11/1995 Yumibe et al.
5,472,592 A 12/1995 Lowery
5,516,412 A 5/1996 Andricacos et al.
5,558,568 A 9/1996 Talieh et al.
5,567,300 A 10/1996 Datta et al.
5,605,637 A 2/1997 Shan et al.
5,681,215 A 10/1997 Sherwood et al.
5,692,947 A 12/1997 Talieh et al.
5,700,366 A 12/1997 Steblianko et al.
5,755,859 A 5/1998 Brusic et al.
5,762,544 A 6/1998 Zuniga et al.
5,770,095 A 6/1998 Saski et al.
5,772,833 A 6/1998 Inazawa et al.
5,773,364 A 6/1998 Farkas et al.
5,793,272 A 8/1998 Burghartz et al.
5,795,215 A 8/1998 Guthrie et al.
5,807,165 A 9/1998 Uzoh et al.
5,833,820 A 11/1998 Dubin
5,840,629 A 11/1998 Carpio
5,846,335 A * 12/1998 Maekawa et al. ..... 134/6
5,858,813 A 1/1999 Scherber et al.
5,862,605 A 1/1999 Horie et al.
5,863,412 A 1/1999 Ichinose et al.
5,884,990 A 3/1999 Burghartz et al.
5,897,375 A 4/1999 Watts et al.
5,911,619 A 6/1999 Uzoh et al.
5,922,091 A 7/1999 Tsai et al.
5,930,669 A 7/1999 Uzoh
5,933,753 A 8/1999 Simon et al.
5,954,997 A 9/1999 Kaufman et al.
5,976,331 A 11/1999 Chang et al.
5,985,123 A 11/1999 Koon
6,001,235 A 12/1999 Arken et al.
6,004,880 A 12/1999 Liu et al.
6,027,631 A 2/2000 Broadbent
6,063,506 A 5/2000 Andricacos et al.
6,066,030 A 5/2000 Uzoh
6,071,388 A 6/2000 Uzoh
6,074,544 A 6/2000 Reid et al.
6,074,546 A 6/2000 Sun et al.
6,103,085 A 8/2000 Woo et al.
6,132,587 A 10/2000 Jorne et al.
6,136,163 A 10/2000 Cheung et al.
6,143,155 A 11/2000 Adams et al.
6,153,064 A 11/2000 Condra et al.
6,156,167 A 12/2000 Patton et al.
6,159,354 A 12/2000 Contolini et al.
6,162,344 A 12/2000 Reid et al.
6,176,992 B1 1/2001 Talieh
6,187,152 B1 2/2001 Ting et al.
6,210,554 B1 4/2001 Kosaki et al.
6,217,734 B1 4/2001 Uzoh
6,224,737 B1 * 5/2001 Tsai et al. ..... 205/123
6,228,231 B1 5/2001 Uzoh
6,251,235 B1 6/2001 Talieh et al.
6,251,236 B1 6/2001 Stevens
6,261,426 B1 7/2001 Uzoh et al.
6,270,646 B1 8/2001 Walton
6,270,647 B1 8/2001 Graham et al.
6,334,937 B1 1/2002 Batz, Jr. et al.
6,346,479 B1 * 2/2002 Woo et al. ..... 438/687
6,353,623 B1 3/2002 Munks et al.
6,375,823 B1 * 4/2002 Matsuda et al. ..... 205/117
6,402,925 B2 6/2002 Talieh
6,413,388 B1 7/2002 Uzoh et al.
6,413,403 B1 7/2002 Lindquist et al.
6,440,295 B1 8/2002 Wang
6,471,847 B2 10/2002 Talieh et al.
6,482,307 B2 11/2002 Ashjaee et al.
6,482,656 B1 11/2002 Lopatin
6,497,800 B1 12/2002 Talieh et al.
6,506,103 B1 1/2003 Ohmori et al.
6,534,116 B2 3/2003 Basol
6,537,133 B1 3/2003 Tsai et al.
6,600,229 B2 7/2003 Mukherjee et al.
6,610,190 B2 8/2003 Basol et al.
6,630,059 B1 10/2003 Uzoh et al.
6,638,411 B1 * 10/2003 Mishima et al. ..... 205/210
6,653,226 B1 11/2003 Reid
6,676,822 B1 1/2004 Talieh
6,756,307 B1 6/2004 Kelly et al.
6,833,063 B2 12/2004 Basol
6,848,970 B2 2/2005 Manens et al.
6,867,136 B2 3/2005 Basol et al.
6,902,659 B2 6/2005 Talieh
6,936,154 B2 8/2005 Basol et al.
6,942,780 B2 9/2005 Basol et al.
6,958,114 B2 10/2005 Talieh et al.
7,405,163 B1 7/2008 Drewery et al.
7,449,098 B1 11/2008 Mayer et al.
7,449,099 B1 11/2008 Mayer et al.
7,531,079 B1 5/2009 Mayer et al.
2001/0015321 A1 * 8/2001 Reid et al. ..... 205/103
2002/0074238 A1 6/2002 Mayer et al.
2002/0102853 A1 8/2002 Li
2003/0054729 A1 3/2003 Lee et al.
2003/0070930 A1 4/2003 Talieh et al.
2003/0089598 A1 5/2003 Basol et al.
2003/0089612 A1 5/2003 Basol et al.
2003/0089615 A1 5/2003 Basol et al.
2003/0094364 A1 5/2003 Talieh et al.
2003/0116440 A1 * 6/2003 Guldi et al. ..... 205/157
2003/0209425 A1 11/2003 Talieh et al.
2003/0209445 A1 11/2003 Talieh et al.
2003/0217932 A1 11/2003 Talieh et al.
2003/0226764 A1 12/2003 Moore et al.
2004/0195111 A1 10/2004 Talieh et al.
2005/0269212 A1 12/2005 Talieh et al.
2006/0006060 A1 1/2006 Basol et al.

FOREIGN PATENT DOCUMENTS

JP 2000 208443 7/2000
WO WO 98/27585 6/1998
WO WO 00/26443 5/2000
WO WO 01/32362 A1 5/2001

OTHER PUBLICATIONS

U.S. Appl. No. 11/232,718, filed Sep. 21, 2005, Uzoh et al.
U.S. Appl. No. 11/313,249, filed Dec. 19, 2005, Basol.
Notification of Transmittal of International Preliminary Examination Report (2 page), International Preliminary Examination Report (6 pages), and annexes (amended sheets 22-30) in connection with PCT/us01/05552.

Contolini et al., "Electrochemical Planarization for Multilevel Metallization," pp. 2503-2510 (Sep. 1994).
Kelly et al., "Leveling and Microstructural Effects of Additives for Copper Electrodeposition," *Journal of Electrochemical Society*, 146(7), pp. 2540-2545 (1999).
Madore et al., "Blocking Inhibitors in Catholic Leveling," *I. Theoretical Analysis*, pp. 3927-3942 (Dec. 1996).
Mikkola et al., "Investigation of the Roles of the Additive Components for Second Generation Copper Electroplating Chemistries Used for Advanced Interconnect Metalization," 2000 IEEE, IEEE Electron Devices Society, pp. 117-119 (Jun. 2000).
Reid et al., "Factors influencing damascene feature fill using copper PVD and electroplating," *Solid State Technology*, 7 pages, (Jul. 2000).
Steigerwald et al., "Pattern Geometry Effects in the Chemical-Mechanical Polishing of Inlaid Copper Structures," pp. 2842-2848 (Oct. 1994).
Steigerwald et al., "Chemical Mechanical Planarization of Microelectronic Materials," A Wiley-Interscience Publication by John Wiley & Sons, pp. 212-222 (1997).
West et al., "Pulse Reverse Copper Electrodeposition in High Aspect Ratio Trenches and Vias," pp. 3070-3074 (Sep. 1998).
U.S. Appl. No. 11/544,957, filed Oct. 5, 2006, Mayer et al.
U.S. Appl. No. 11/602,128, filed Nov. 20, 2006, Mayer et al.
U.S. Appl. No. 11/893,374, filed Aug. 14, 2007, Mayer et al.
U.S. Appl. No. 12/291,277, filed Nov. 7, 2008, Mayer et al.

* cited by examiner

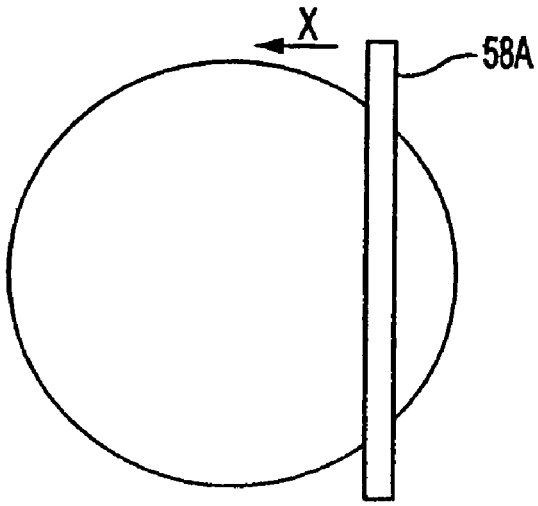
FIG. 5d1
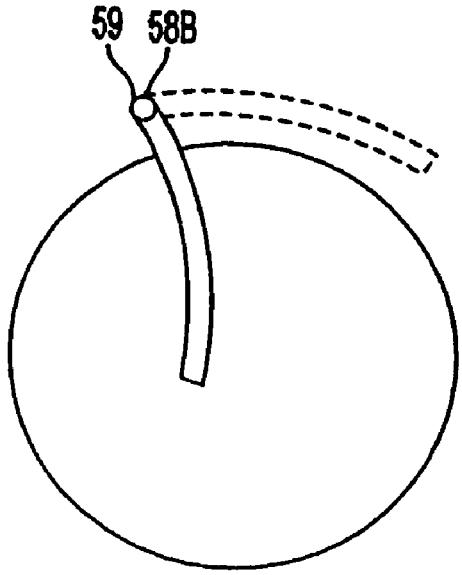
FIG. 5d2

METHOD FOR CONTROLLING CONDUCTOR DEPOSITION ON PREDETERMINED PORTIONS OF A WAFER

This application is a continuation-in-part of U.S. patent application Ser. No. 11/190,763, filed Jul. 26, 2005 (now U.S. Pat. No. 7,517,444), which is a continuation of U.S. patent application Ser. No. 09/961,193, filed Sep. 20, 2001 (now U.S. Pat. No. 6,921,551), which is a continuation-in-part of U.S. patent application Ser. No. 09/919,788, filed Jul. 31, 2001 (now U.S. Pat. No. 6,858,121), which is a continuation-in-part of U.S. patent application Ser. No. 09/740,701, filed Dec. 18, 2000 (now U.S. Pat. No. 6,534,116), which claims priority to U.S. Provisional Application No. 60/224,739, filed Aug. 10, 2000.

BACKGROUND

1. Field of the Invention

The present invention generally relates to an electroplating method and apparatus and, more particularly, to an apparatus that creates a differential between additives adsorbed on different portions of a workpiece using an external influence and thus either enhance or retard plating of a conductive material on such portions.

2. Description of the Related Art

There are many steps required in manufacturing multilevel interconnects for integrated circuits (IC). Such steps include depositing, conducting, and insulating materials on a semiconductor wafer or workpiece followed by full or partial removal of these materials, using photo-resist patterning, etching, and the like. After photolithography, patterning, and etching steps, the resulting surface of the wafer is generally non-planar as it contains many cavities or features, such as vias, contact holes, lines, trenches, channels, bond-pads, and the like, that come in a wide variety of dimensions and shapes. These features are typically filled with a highly conductive material before additional processing steps, such as etching and/or chemical mechanical polishing (CMP), are performed. Accordingly, a low resistance interconnection structure is formed between the various sections of the IC after completing these deposition and removal steps multiple times.

Copper (Cu) and Cu alloys are quickly becoming the preferred materials for interconnections in ICs because of their low electrical resistivity and high resistance to electro-migration. Electrodeposition is one of the most popular methods for depositing Cu into the features on a workpiece surface. Therefore embodiments will be described for electroplating Cu although they are in general applicable for electroplating any other material. During a Cu electrodeposition process, specially formulated plating solutions or electrolytes are typically used. These solutions or electrolytes typically contain ionic species of Cu and additives to control the texture, morphology, and the plating behavior of the deposited material (e.g., Cu). Additives are needed to obtain smooth and well-behaved deposited layers. There are many types of Cu plating solution formulations, some of which are commercially available. One such formulation includes Cu-sulfate ($CuSO_4$) as the copper source (see, for example, James Kelly et al., Journal of The Electrochemical Society, Vol. 146, pages 2540-2545, (1999)) and includes water, sulfuric acid ($H_2SO_4$), and a small amount of chloride ions. As is well known, other chemicals, referred to as additives, are generally added to the Cu plating solution to achieve desired properties of the deposited material. These additives become attached to or chemically or physically adsorbed on the surface of the substrate to be coated with Cu and therefore influence the plating there, as will be described below.

The additives in Cu plating solution can be classified under several categories, such as accelerators, suppressors/inhibitors, levelers, brighteners, grain refiners, wetting agents, stress-reducing agents, etc. In many instances, different classifications are often used to describe similar functions of these additives. Today, solutions used in electronic applications, particularly in manufacturing ICs, contain simpler two-component additive packages (see e.g., Robert Mikkola and Linlin Chen, "Investigation of the Roles of the Additive Components for Second Generation Copper Electroplating Chemistries used for Advanced Interconnect Metallization," Proceedings of the International Interconnect Technology Conference, pages 117-119, Jun. 5-7, 2000). These formulations are generically known as suppressors and accelerators. Some recently introduced packages, such as, for example, Via-Form chemistry marketed by Enthone, Inc. of West Haven, Conn. and Nano-Plate chemistry marketed by Shipley, now Rohm and Haas Electronic Materials of Marlborough, Mass., also include a third component, which is typically referred to as a leveler.

Suppressors or inhibitors are typically polymers and are believed to attach themselves to the workpiece surface at high current density regions, thereby forming, in effect, a high resistance film, and increasing polarization there and suppressing the current density and therefore the amount of material deposited thereon. Accelerators, on the other hand, enhance Cu deposition on portions of the workpiece surface where they are adsorbed, in effect reducing or eliminating the inhibiting function of the suppressor. Levelers are typically added in the formulation to avoid formation of bumps or overfill over dense and narrow features, as will be described in more detail hereinafter. Chloride ions affect suppression and acceleration of deposition on various parts of the workpiece (see Robert Mikkola and Linlin Chen, "Investigation" Proceedings article referenced above). The interplay between these additives determines the nature of the Cu deposit.

The following figures are used to more fully describe a conventional electrodeposition method and apparatus. FIG. 1 illustrates a cross-sectional view of an exemplary workpiece 3 having an insulator 2 formed thereon. Using conventional deposition and etching techniques, features, such as a dense array of small vias 4*a*, 4*b*, 4*c* and a dual damascene structure 4*d* are formed on the insulator 2 and the workpiece 3. In this example, the vias 4*a*, 4*b*, 4*c* are narrow and deep; in other words, they have high aspect ratios (i.e., their depth to width ratio is large). Typically, the widths of the vias 4*a*, 4*b*, 4*c* may be sub-micron. The dual-damascene structure 4*d*, on the other hand, has a wide trench 4*e* and a small via 4*f* on the bottom. The wide trench 4*e* has a small aspect ratio.

FIGS. 2*a*-2*c* illustrate a conventional method for filling the features of FIG. 1 with Cu. FIG. 2*a* illustrates the exemplary workpiece of FIG. 1 having various layers disposed thereon. For example, FIG. 2*a* illustrates the workpiece 3 and the insulator 2 having deposited thereon a barrier/glue or adhesion layer 5 and a seed layer 6. The barrier/glue layer 5 may be tantalum, nitrides of tantalum, titanium, tungsten, or TiW, etc., or combinations of any other materials that are commonly used in this field. The barrier/glue layer 5 is generally deposited using any of a variety of various sputtering methods, chemical vapor deposition (CVD), etc. Thereafter, the seed layer 6 is typically deposited over the barrier/glue layer 5. The seed layer 6 may be formed of copper or copper substitutes and may be deposited on the barrier/glue layer 5 using various methods known in the field.

As shown in FIG. 2*b*, after depositing the seed layer 6, a conductive material 7 (e.g., a copper layer) is electrodeposited thereon from a suitable plating bath. During this step, an electrical contact is made to the Cu seed layer 6 and/or the barrier layer 5 so that a cathodic (negative) voltage can be applied thereto with respect to an anode (not shown). Thereafter, the Cu material 7 is electrodeposited over the workpiece surface, using the specially formulated plating solutions, as discussed above. It should be noted that the seed layer 6 is shown as an integral part of the deposited copper layer 7 in FIG. 2*b*. By adjusting the amounts of the additives, such as the chloride ions, suppressors/inhibitors, and the accelerators, it is possible to obtain bottom-up Cu film growth in the small features.

As shown in FIG. 2*b*, the Cu material 7 completely fills the vias 4*a*, 4*b*, 4*c*, 4*f* and is generally conformal in the large trench 4*e*. Copper does not completely fill the trench 4*e* because the additives that are used in the bath formulation are not operative in large features. For example, it is believed that the bottom-up deposition into the vias and other features with large aspect ratios occurs because the suppressor/inhibitor molecules attach themselves to the top portion of each feature opening to suppress the material growth thereabouts. These molecules cannot effectively diffuse to the bottom surface of the high aspect ratio features, such as the vias of FIG. 1 through the narrow openings. Preferential adsorption of the accelerator on the bottom surface of the vias, therefore, results in faster growth in that region, resulting in bottom-up growth and the Cu deposit profile as shown in FIG. 2*b*. Without the appropriate additives, Cu can grow on the vertical walls as well as the bottom surface of the high aspect ratio features at the same rate, thereby causing defects, such as seams and voids, as is well known in the industry.

Adsorption characteristics of the suppressor and accelerator additives on the inside surfaces of the low aspect-ratio trench 4*e* is not expected to be any different than the adsorption characteristics on the top surface or the field region 8 of the workpiece. Therefore, the Cu thickness at the bottom surface of the trench 4*e* is about the same as the Cu thickness over the field regions 8. Field region is defined as the top surface of the insulator in between the features etched into it.

As can be expected, to completely fill the trench 4*e* with the Cu material 7, further plating is required. FIG. 2*c* illustrates the resulting structure after additional Cu plating. In this case, the Cu thickness t3 over the field region 8 is relatively large and there is a step s1 from the field regions 8 to the top of the Cu material 7 in the trench 4*d*. Furthermore, if there is no leveler included in the electrolyte formulation, the region over the high aspect-ratio vias can have a thickness t4 that is larger than the thickness t3 near the large feature 4*d*. This phenomenon is sometimes referred to as "overfill" and is believed to be due to enhanced deposition over the high aspect ratio features resulting from the high accelerator concentration in these regions. Apparently, accelerator species that are preferentially adsorbed in the small vias, as explained above, stay partially adsorbed even after the features are filled. For IC applications, the Cu material 7 needs to be subjected to CMP or another material removal process so that the Cu material 7 as well as the barrier layer 5 in the field regions 8 are removed, thereby leaving the Cu material 7 only within the features, as shown in FIG. 2*d*. The situation shown in FIG. 2*d* is an ideal result. In reality, these material removal processes are known to be quite costly and problematic. A non-planar surface with thick Cu, such as the one depicted in FIG. 2*c*, has many drawbacks. First, removal of a thick Cu layer is time consuming and costly. Secondly, the non-uniform surface cannot be removed uniformly and results in dishing defects in large features, as is well known in the industry and as shown in FIG. 2*e*.

Thus far, much attention has been focused on the development of Cu plating chemistries and plating techniques that yield bottom-up filling of small features on a workpiece. This is necessary because, as mentioned above, the lack of bottom-up filling can cause defects in the small features. Recently, levelers have been added into the electrolyte formulations to avoid overfilling over high aspect ratio features. As bumps or overfill start to form over such features, leveler molecules are believed to attach themselves over these high current density regions, i.e. bumps or overfill, and reduce plating there, effectively leveling the film surface. Therefore, special bath formulations and pulse plating processes have been developed to obtain bottom-up filling of the small features and reduction or elimination of the overfilling phenomenon.

A new class of plating techniques, called Electrochemical Mechanical Deposition (ECMD), has been developed to deposit planar films over workpieces with cavities of all shapes, sizes and forms. Methods and apparatuses for to achieving thin and planar Cu deposits on electronic workpieces, such as semiconductor wafers, are invaluable in terms of process efficiency. Such a planar Cu deposit is depicted in FIG. 3. The Cu thickness t5 over the field regions 8 in this example is smaller than in the traditional case shown in FIG. 2*c*. Removal of the thinner Cu layer in FIG. 3 by CMP, etching, electropolishing or other methods would be easier, thereby providing important cost savings. Dishing defects are also expected to be minimal in removing planar layers such as the one shown in FIG. 3.

Recently issued U.S. Pat. No. 6,176,992, entitled "Method and Apparatus for Electro-Chemical Mechanical Deposition", commonly owned by the assignee of the present invention and hereby incorporated herein by reference in its entirety, discloses, in one aspect, a technique that achieves deposition of the conductive material into the cavities on the workpiece surface while minimizing deposition on the field regions. This ECMD process results in planar material deposition.

U.S. Pat. No. 6,534,116, U.S. application Ser. No. 09/740,701, entitled "Plating Method And Apparatus That Creates A Differential Between Additive Disposed On A Top Surface And A Cavity Surface Of A Workpiece Using An External Influence" and also assigned to the same assignee as the present invention and hereby incorporated herein by reference in its entirety, describes, in one aspect, an ECMD method and apparatus that cause a differential in additives to exist for a period of time between a top surface and a cavity surface of a workpiece. While the differential is maintained, power is applied between an anode and the workpiece to cause greater relative plating of the cavity surface as compared to the top surface of the workpiece.

Other patents and filed applications that relate to specific improvements in various aspects of ECMD processes include: U.S. patent application Ser. No. 09/511,278, entitled "Pad Designs and Structures for a Versatile Materials Processing Apparatus," filed Feb. 23, 2000, now U.S. Pat. No. 6,413,388; U.S. patent application Ser. No. 09/621,969, entitled "Method and Apparatus Employing Pad Designs and Structures with Improved Fluid Distribution," filed Jul. 21, 2000, now U.S. Pat. No. 6,413,403; U.S. patent application Ser. No. 09/960,236, entitled "Mask Plate Design," filed Sep. 20, 2001, now U.S. Pat. No. 7,201,829, which claims a benefit to U.S. Provisional Application Ser. No. 60/272,791, filed Mar. 1, 2001; U.S. patent application Ser. No. 09/671,800, entitled "Method to Minimize and/or Eliminate Conductive Material Coating Over the Top Surface of a Patterned Substrate and Layer Structure Made Thereby," filed Sep. 28, 2000; and U.S. patent application Ser. No. 09/760,757, entitled "Method and Apparatus for Electrodeposition of Uniform Film with Minimal Edge Exclusion on Substrate," now U.S. Pat. No. 6,610,190, all of which applications are assigned to the same assignee as the present application. All of the foregoing patents and applications are hereby incorporated herein by reference in their entireties.

While the above-described ECMD processes provide numerous advantages, further refinements that allow for greater control of material deposition in areas corresponding to various cavities, to yield new and novel conductor structures, are desirable.

SUMMARY

According to an aspect of the invention, a system is provided for electrodepositing a conductive material onto a surface of a wafer. The surface includes a surface portion and a cavity portion. The system comprises an auxiliary chamber and a plating chamber. The auxiliary chamber is configured for establishing a differential in an adsorbed concentration of an additive between the surface portion and the cavity portion of the surface. The plating chamber is configured to electrodeposit the conductive material to form a conductive layer on the surface.

According to another aspect of the invention, a system is provided for electrodepositing a conductive material onto a surface of a wafer. The surface includes a surface portion and a cavity portion. The system comprises a first chamber and a second chamber. The first chamber includes an additive differential forming means for establishing a differential in an adsorbed concentration of an additive between the surface portion and the cavity portion of the surface. The second chamber includes a plating means for electrodepositing the conductive material on the surface.

According to yet another aspect of the invention, a method is provided for electrodepositing a conductive material onto a surface of a wafer. The surface includes a surface portion and a cavity portion. A differential is established in an adsorbed concentration of an additive between the surface portion and the cavity portion of the surface in a first chamber. The wafer is transported to a second chamber after the differential is established, and the conductive material is electrodeposited to form a conductive layer on the surface in the second chamber.

BRIEF DESCRIPTION OF THE DRAWINGS

FIGS. 5*a*-5*c*, 5*d*1, and 5*d*2 illustrate various sweepers that can be used with the electrochemical mechanical deposition apparatus according to an embodiment;

DETAILED DESCRIPTION

Preferred embodiments of the present invention will now be described with reference to the following figures. By plating the conductive material on a workpiece surface using the embodiments described herein, a more desirable and high quality conductive material can be deposited in the various features therein.

The methods and apparatuses described herein can be used with any workpiece, such as a semiconductor wafer, flat panel, magnetic film head, packaging substrate, and the like. Further, specific processing parameters, such as material, time and pressure, and the like are described herein, which specific parameters are intended to be explanatory rather than limiting. For example, although copper is given as an exemplary plated material, any other material can be electroplated using the embodiments described herein, provided that the plating solution contains at least one of plating enhancing and inhibiting additives.

Figure 8C:
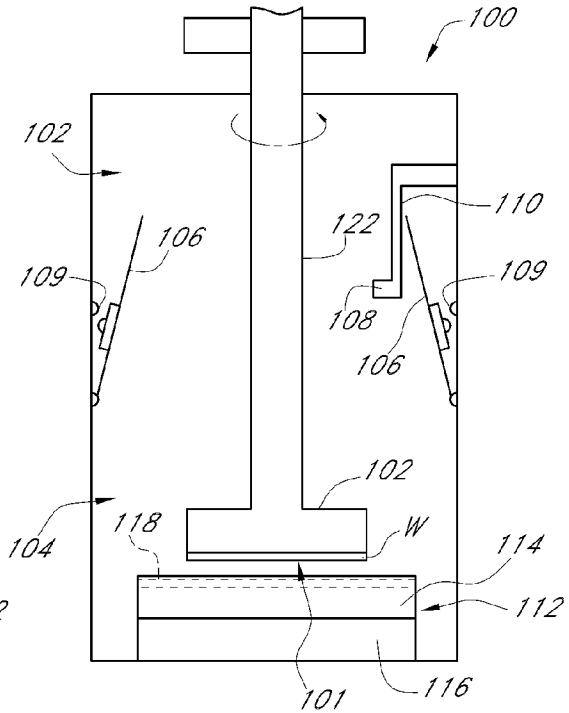
FIG. 8A-8C illustrate a system of the present invention including an auxiliary chamber and a plating chamber.
Figure 8B:
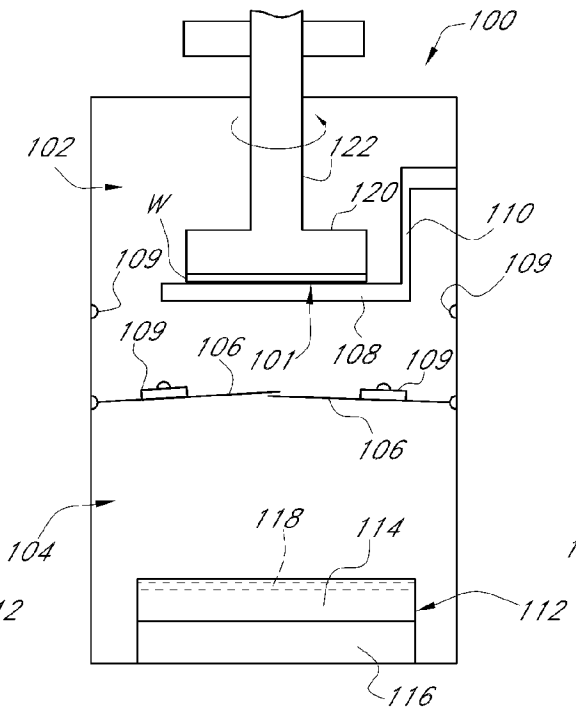
Figure 8A:
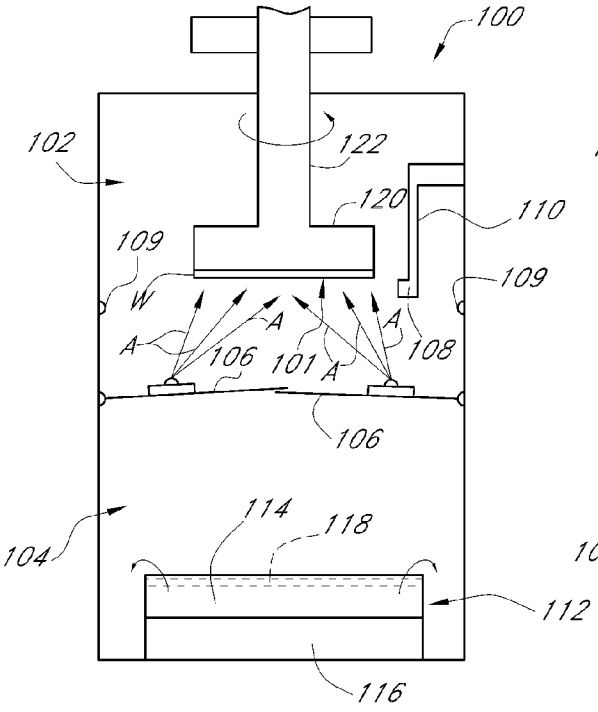

An embodiment of a plating method described herein is a type of ECMD technique where an external influence is used on the workpiece surface to influence additive adsorption thereon. According to this embodiment, a method and apparatus are provided for plating conductive material onto a workpiece by moving a workpiece-surface-influencing device, such as a mask or sweeper as described further herein positioned between an anode and the workpiece, to at least intermittently make contact with various surface areas of the workpiece surface to establish an additive differential between the top surface of the workpiece and the workpiece cavity features. Once the additive differential is established, power that is applied between the anode and the workpiece will cause plating to occur on the workpiece surface, typically more predominantly within the cavity features than on the top surface. It should be noted that the workpiece-surface-influencing device may be applied to the top surface at any time before or during plating or the application of power, to establish an additive differential. An apparatus that can be used to apply the workpiece-surface-influencing device to the top surface before the plating to establish an additive differential is shown in FIGS. 8A-8C and will be described below.

Some embodiments may also include a shaping plate, as also described further herein. Furthermore, some embodiments are directed to a novel plating method and apparatus that provide enhanced electrodeposition of conductive materials into and over various features on a workpiece surface while reducing plating over others.

The distinctions that are intended to be made herein between a mask (which can also be termed a pad, but will herein be referred to as a mask), a sweeper and a shaping plate will first be described. U.S. Pat. No. 6,176,992 and U.S. Pat. No. 6,534,116 (referenced above), there is described a mask that sweeps the top surface of a workpiece and also provides an opening or openings of some type through which the flow of electrolyte therethrough can be controlled. While such a mask works relatively well, a combination of two different components, a sweeper and a shaping plate (which can also be referred to as a diffuser), can alternatively be used, although it is noted that a shaping plate can also be used with a mask, though in such instance there is redundant functionality between the two.

It has also been found that while having both a sweeper and a shaping plate is desirable, that the certain embodiments can be practiced using only a sweeper. Accordingly, the workpiece-surface-influencing device referred to herein may include a mask, a pad, a sweeper, and other variants thereof that are usable to influence the top surface of the workpiece more than surfaces that are below the level of the top surface, such as surfaces within cavity features. It should be understood that there are workpiece-surface-influencing devices other than a mask or a sweeper that could potentially be utilized. The embodiments described herein are not meant to be limited to the specific mask and sweeper devices described herein, but rather, include any mechanism that through the action of sweeping establishes a differential between the additive content on the swept and the unswept surfaces of the workpiece. This differential is such that it causes more material deposition onto the unswept regions (in terms of per unit area) than the swept regions. This means the plating current density is higher on unswept surfaces than on swept surfaces.

Figure 4:
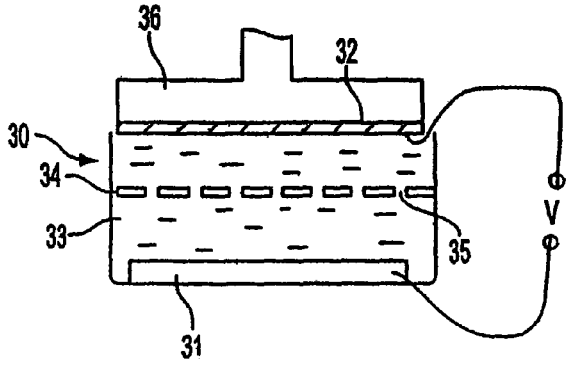
FIG. 4 (PRIOR ART)
FIG. 4 illustrates a conventional plating apparatus.

FIG. 4 illustrates a conventional Cu plating cell 30 having therein an anode 31, a cathode 32, and an electrolyte 33. It should be noted that the plating cell 30 maybe any conventional cell and its exact geometry is not a limiting factor. For example, the anode 31 may be placed in a different container in fluid communication with the plating cell 30. Both the anode 31 and the cathode 32 may be vertical or the anode 31 may be over the cathode 32, etc. There may also be a diffuser or shaping plate 34 in between the anode 31 and the cathode 32 to assist in providing a uniform film deposition on the workpiece. The shaping plate 34 will typically have asperities 35 that control fluid and electric field distribution over the cathode area to assist in attempting to deposit a globally uniform film on the workpiece.

Other conventional ancillary components can be used along with the embodiments described herein, but are not necessary to the practice of the embodiments. Such components include well known electroplating "thieves" and other means of providing for uniform deposition that may be included in the overall plating cell design. There may also be filters, bubble elimination means, anode bags, etc. used for purposes of obtaining defect free deposits.

The electrolyte 33 is in contact with the top surface of the cathode 32. The cathode 32 in the examples described herein is a workpiece. For purposes of this description, the workpiece will be described as a wafer having various features on its top surface, and it is understood that any workpiece having such characteristics can be operated upon by the embodiments described herein. The wafer 32 is held by a wafer holder 36. Any type of wafer holding approaches that allow application of power to the conductive surface of the wafer 32 may be employed. For example, a clamp with electrical contacts holding the wafer 32 at its front circumferential surface may be used. Another, and a more preferred method, is holding the wafer 32 by vacuum at its back surface exposing the full front surface for plating. One such approach is provided in U.S. Provisional Application No. 60/272,791, filed Mar. 1, 2001, entitled "Mask Plate Design." When a DC or pulsed voltage, V, is applied between the wafer 32 and the anode 31, rendering the wafer mostly cathodic, Cu from the electrolyte 33 may be deposited on the wafer 32 in a globally uniform manner. In terms of local uniformity, however, the resulting copper film typically looks like the one depicted in FIG. 2*c*. In case there is leveling additive(s) in the electrolyte 33, the thickness t3 may be approximately equal to the thickness t4 since the overfilling phenomenon would be mostly eliminated by the use of leveler. Power may be applied to the wafer 32 and the anode 31 in a current-controlled or voltage-controlled mode. In a current-controlled mode, the power supply controls the current and lets the voltage vary to support the controlled amount of current through the electrical circuit. In a voltage-controlled mode, the power supply controls the voltage allowing current to adjust itself according to the resistance in the electrical circuit.

Figure 5:
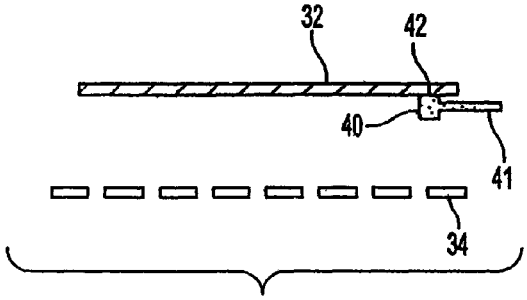
FIG. 5 illustrates an electrochemical mechanical deposition apparatus according to an embodiment.

FIG. 5 illustrates a first preferred embodiment, which can be made not only as a new device, but also by modifying the conventional plating apparatus, such as that described above in FIG. 4. In this embodiment, a sweeper 40 is positioned in close proximity to the wafer 32. For simplicity, FIG. 5 only shows the shaping plate 34, the wafer 32 and the sweeper 40. During processing, the sweeper 40 makes contact with the top surface of the wafer 32, sweeping it so that during at least part of the time copper deposition is performed, the additive differential exists. The sweeper 40 may be of any size and shape and may have a handle 41 that moves the sweeper 40 on the wafer surface, preferably using programmable control, and can also be retractable so that it moves the sweeper 40 entirely off of the area above the top surface of the wafer 32, which will result in even less interference than if the sweeper 40 is moved away from the wafer 32 so that physical contact between the sweeper 40 and the wafer 32 does not exist, as also described herein. The handle 41 preferably has a surface area that is small so as to minimize interference by the handle 41 with plating uniformity. The handle 41 may also be coated with an insulating material on its outside surface, or made of a material, that will not interfere with the process chemistry or the electric fields used during plating.

It is preferable that the sweeper area 42 that makes contact with the wafer 32 surface be small compared to the wafer surface so that it does not appreciably alter the global uniformity of Cu being deposited. There may also be small openings through the sweeper 40 and the handle 41 to reduce their effective areas that may interfere with plating uniformity. There may be means of flowing electrolyte 33 through the handle 41 and the sweeper 40 against the wafer 32 surface to be able to apply fluid pressure and push the sweeper away from the wafer surface when desired. As explained above, the sweeper area 42 is preferably small. For example, for a 200 mm diameter wafer with a surface area of approximately 300 $cm^2$, the surface area of the sweeper 40 is preferably less than 50 $cm^2$, and is more preferably less than 20 $cm^2$. In other words, in a preferred embodiment, the sweeper 40 is used to produce an external influence on the wafer 32 surface. The global uniformity of the deposited Cu is also determined and controlled by other means, such as the shaping plate 34, that are included in the overall design. The sweeping action may be achieved by moving the sweeper 40, the wafer 32, or both in linear and/or orbital fashion.

Figure 5A:
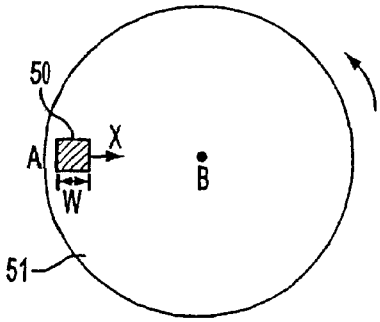

The sweeping motion of the sweeper may be a function of the shape of the sweeper. For example, FIG. 5*a* shows an exemplary sweeper 50 on an exemplary wafer 51. The moving mechanism or the handle of the sweeper 50 is not shown in this figure, and can be implemented using conventional drive devices. In the illustrated embodiment, the wafer 51 is rotated about its center B. As the wafer 51 is rotated, the sweeper 50 is scanned over the surface of the wafer 51 between the positions A and B in the illustrated "x" direction, as shown in FIG. 5*a*. This way, if the velocity of the scan is appropriately selected, every point on the wafer 51 surface would be swept by the sweeper 50 intermittently. The velocity of the sweeper 50 may be kept constant, or it may be increased towards the center of the wafer 51 to make up for the lower linear velocity of the wafer 51 surface with respect to the sweeper 50 as the origin B of the wafer rotation is approached. The motion of the sweeper 50 can be continuous or the sweeper 50 may be moved incrementally over the surface. For example, the sweeper 50 may be moved from location A to B at increments of W and it can be kept at each incremental position for at least one revolution of the rotating wafer 51 to assure it sweeps every point on the wafer surface. There may be a device, such as an ultrasonic transducer, installed in the sweeper 50 structure that increases the efficiency of the sweeping action and thus establishes more additive differential during a shorter time period. The wafer 51, in addition to rotation, may also be translated laterally during the sweeping process. While the relative movement preferably occurs at average speeds between the range of 1 to 100 cm/s, it is understood that the relative movement speed is one variable that can be used to control the resulting plating process, with other variables noted herein. In a modification of this embodiment, the two positions A and B can be at opposite ends of the wafer 51, in which case the sweeper 50 moves across the diameter of the wafer 51.

An alternate embodiment provides a stationary wafer and a sweeper that is programmed to move over the wafer surface to sweep every point on the surface. Many different sweeper motions, both with and without motion of the wafer, may be utilized to achieve the desired sweeper action on the wafer surface.

Figure 5B:
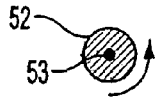

One particularly advantageous sweeper embodiment, shown in FIG. 5*b*, is a rotational sweeper 52, which can move around axis 53. In this case, when the sweeper 52 is translated on the wafer surface, the wafer does not necessarily need to be moved because the relative motion between the wafer surface and the sweeper 52, which is necessary for sweeping the wafer surface, is provided by the rotating sweeper 52. One attractive feature of this design is the fact that this relative motion would be constant everywhere on the wafer, including at the center point B of the wafer. It should be noted that the rotational sweeper 52 may be designed in many different shapes although the preferred shape is circular, as illustrated. It should also be noted that more than one circular sweeper may be operating on the wafer surface.

Figure 5C:
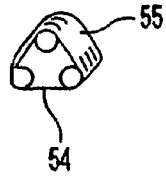

As shown in an alternative embodiment in FIG. 5*c*, the sweeper may also be in the form of a small rotating sweeping belt 55 (rotating drive mechanism not shown, but being of conventional drive mechanisms) with a sweeping surface 54 resting against the wafer surface. Again, more than one such sweeper may be employed.

Each of the sweepers 50, 52, 55 illustrated in FIGS. 5*a*-5*c* can be adapted to be placed on the end of a handle 41, as described above, such that the motion of the sweeper relative to the workpiece surface can be programmably controlled. Further, for embodiments, such as those illustrated in FIGS. 5*b* and 5*c*, where the sweeper itself is rotating about some axis, such as the center of the circular pad in FIG. 5*b* and around the small rollers in FIG. 5*c*, this rotation can also be separately and independently programmably controlled.

Figure 1:
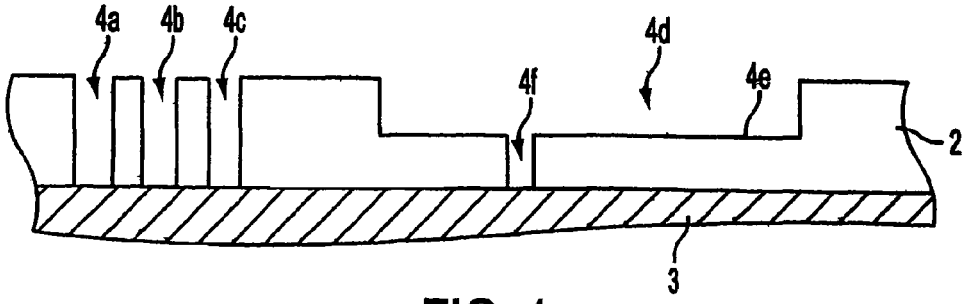
FIG. 1 illustrates a cross-section of a portion of a workpiece structure with features therein for application of a conductive material thereover.

Another practical sweeper shape is a thin bar or wiper 58, which is shown in FIGS. 5*d*1 and 5*d*2 as being a straight bar 58A and a curved bar 58B, respectively. This bar 58 may be swept over the wafer surface in a given direction, such as the "x" direction shown in FIG. 5*d*1, under programmable control, and, if cylindrical, may also rotate around an axis. The bar 58 could also be stationery when being used, and, if desired, be pivotable about a pivot point so that it could be removed from over the wafer surface when not in use, as shown in FIG. 5*d*2 with bar 58B and pivot 59. For each of the sweepers 58A, 58B described above, the surface area of the sweeper portion of the sweeper 58A, 58B that will physically contact the top surface of the wafer preferably has a size that is substantially less than the top surface of the wafer. Preferably, the surface area of the sweeper portion that contacts the top surface of the wafer is less than 20% of the surface area of the wafer, and more preferably less than 10% of the surface area of the wafer. For the bar or wiper type sweeper, this percentage is preferably even less.

The body of the sweepers described above may be made of a composite of materials, as with the mask described above, with the outer surface made of any material that is stable in the plating solution, such as, for example, polycarbonate, Teflon, polypropylene and the like. It is, however, preferable, that at least a portion of the sweeping surface be made of a flexible insulating abrasive material that may be attached on a foam backing to provide uniform and complete physical contact between the wafer surface and the sweeping surface. And while the sweeping surface may be flat or curved, formed in the shape of a circular pad, or a rotating belt, the surface of the sweeper that sweeps the top surface of the wafer should preferably be flat in macroscopic scale, with microscopic roughness allowed, to provide for efficient sweeping action. In other words, the sweeper surface may have small size protrusions on it. However, if there are protrusions, they preferably should have flat surfaces, which may require conditioning of the sweeper, much like conditioning of conventional CMP pads. With such a flat surface, the top surface of the wafer is efficiently swept without sweeping inside the cavities.

If the sweeping surface is not flat, which may be the case when soft materials, such as polymeric foams of various hardness scales are used as sweeping surfaces, it is noted that the softer the material of the sweeper, the more likely it will sag into the cavities on the wafer surface during sweeping. As a result, the additive differential established between the top surface and the cavity surfaces will not be as large and process efficiency is lost. Such a softer sweeper material can nevertheless be useful to fill deep features on a wafer or other type of workpiece in which any defects, such as scratches on the wafer surface layer, are to be minimized or avoided. While the soft sweeper cannot efficiently fill the cavity once the cavity is filled to a level that corresponds to the sag of the soft material, preferential filling can exist until that point is reached. Beyond that point preferential filling of cavities may cease, and plating current may be distributed uniformly all over the surface of the wafer.

Referring again to FIG. 5, which could use any of the sweepers as described above, as the sweeper 40 moves over the surface of the wafer 32, it influences the additive concentrations adsorbed on the specific wafer surface areas it touches. This creates a differential between the additive content on the top surface and within the cavities that are not physically swept by the sweeper. This differential, in turn, alters the amount of material deposited on the swept areas relative to the areas in the cavities.

Figure 2A:
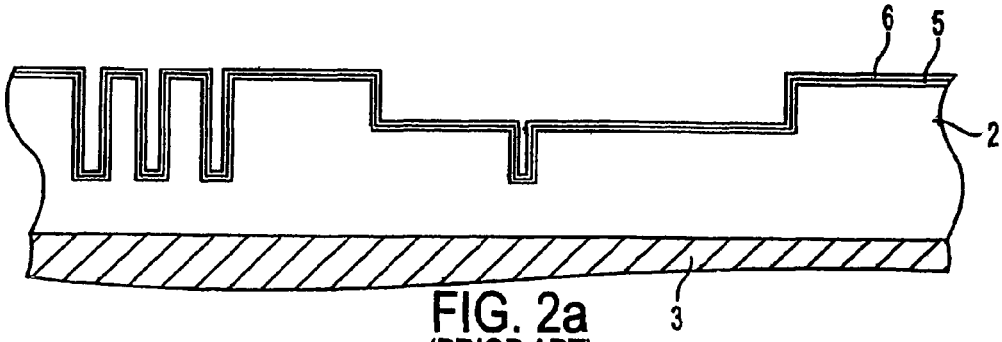
FIG. 2a (PRIOR ART)
FIGS. 2*a*-2*c* illustrate using various cross-sectional views a conventional method for filling the features of FIG. 1 with a conductor.
Figure 2B:
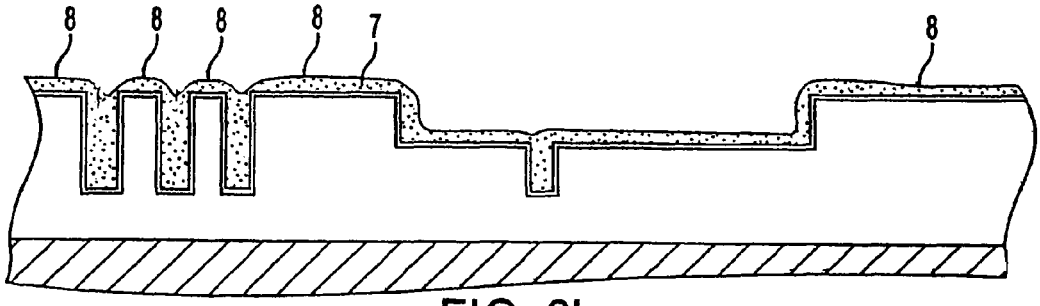
FIG. 2b (PRIOR ART)
Figure 2C:
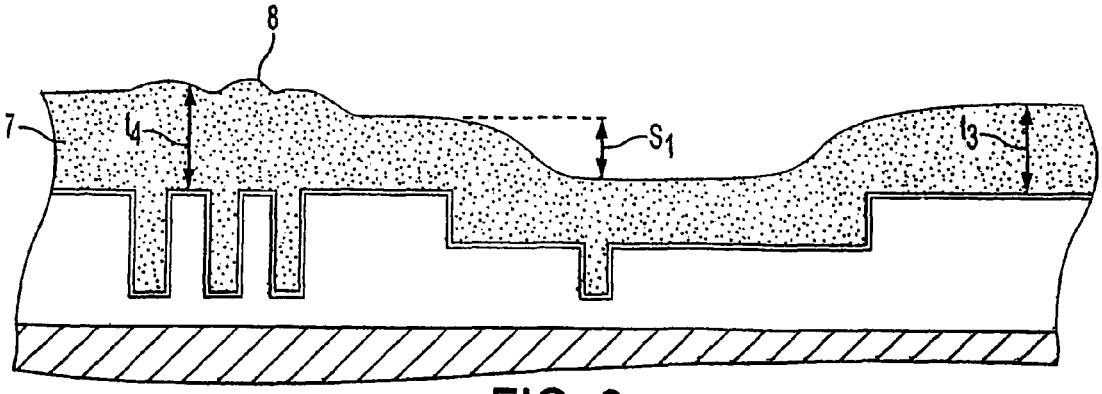
FIG. 2c (PRIOR ART)
Figure 2D:
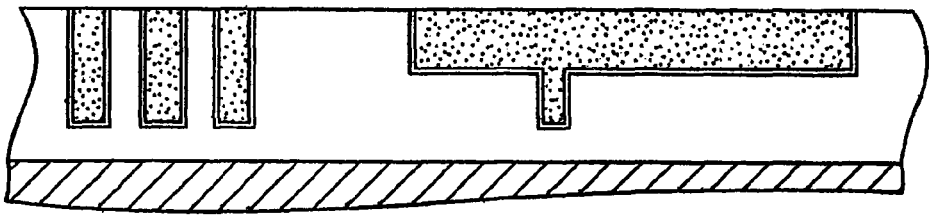
FIG. 2D illustrates a cross-sectional view of an ideal workpiece structure containing a conductor within the features.

For example, consider a conventional Cu plating bath containing Cu sulfate, water, sulfuric acid, chloride ions and two types of additives (an accelerator and a suppressor). When used together, it is known that the suppressor inhibits plating on surfaces on which it is adsorbed and the accelerator reduces or eliminates this current or deposition inhibition action of the suppressor. Chloride is also reported to interact with these additives, affecting the performance of suppressing and accelerating species. When such an electrolyte is used in a conventional plating cell 30, such as the one depicted in FIG. 4, the resulting copper structure 7 is as shown in FIG. 2*c*. If, however, the sweeper 40 starts to sweep the surface of the wafer after conventional plating is carried out initially to obtain the copper structure 7 shown in FIG. 2*b*, the additive content on the surface regions is influenced by the sweeping action and various Cu film profiles, as described hereinafter, will result.

Figure 6A:
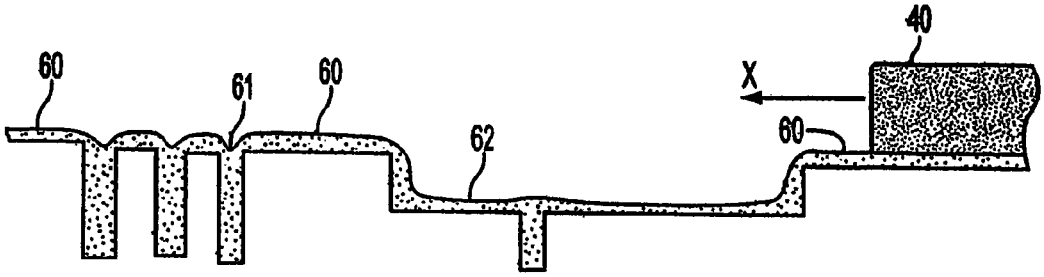
FIGS. 6*a*-6*e*, 6*dd*, and 6*ee* illustrate using various cross sectional views a method for obtaining desirable semiconductor structures according to an embodiment.

FIG. 6*a* (which is the same as FIG. 2*b*), shows the instant (referred to as time zero herein) sweeper 40 sweeps the top surface areas 60 of the wafer that also has the above-described exemplary cavity structure, by moving across its top surface in the direction x, preferably at a velocity of 2-50 mm/sec and an applied pressure, preferably in the range of 0.1-2 psi. The wafer may also be moving at the same time. It should be noted that the barrier/glue layer is not shown in some of the figures in this application for the purpose of simplifying the drawings. By mechanically sweeping the top surface regions 60, the sweeper 40 establishes a differential between the additives adsorbed on the top surfaces 60 and the exemplary small cavities 61 and the large cavity 62. This differential is such that there is less current density inhibition in the cavities 61, 62 compared to the top surface region 60, or in effect current density enhancement through the cavity surfaces. There may be many different ways the differential in additive content between the swept and unswept regions of the top surface may give rise to enhanced deposition current density through the unswept surfaces. For example, in the case of an electroplating bath comprising at least one accelerator and one suppressor, the sweeper 40 may physically remove at least part of the accelerator species from the surface areas therefore leaving behind more of the suppressor species. Or, alternatively, the sweeper may remove at least a portion of both accelerator and suppressor species from the top surface but the suppressor may adsorb back onto the swept surfaces faster than the accelerator right after the sweeper is removed from the surface. Another possibility is that activation of the top surfaces by the mechanical sweeping action may actually play a role in the faster adsorption of suppressor species, since it is known that freshly cleaned, in this case, swept material surfaces are more active than unclean surfaces in attracting adsorbing species. Another possible mechanism that may be employed is using an additive or a group of additives that, when adsorbed on a surface, enhance deposition there, compared to a surface without adsorbed additives. In this case, the sweeper can be used to sweep away and thus reduce the total amount of additives on the swept surfaces and therefore reduce plating there compared to the unswept surfaces. It should also be noted that certain additives may act as accelerators or suppressors, depending upon their chemical environment or other processing conditions, such as the pH of the solution, the plating current density, other additives in the formulation, etc.

After the sweeper 40 sweeps the top surface 60 at time zero, the sweeper 40 is moved away from the top surface 60 of the wafer, and plating continues on the exemplary cavity structure. However, because of the additive differential caused by the sweeper 40, more plating takes place into the cavity regions, with no further sweeping action occurring to result in the Cu deposit at a time t1, shown in FIG. 6*b*. Small bumps or overfill 65 may form over the vias due to the overfilling phenomena discussed earlier. If a leveler is also included in the chemistry, these bumps can be avoided; however, as discussed hereinafter, these bumps can be eliminated without the need of a leveler.

The sweeper 40 is preferably moved away from the surface 60 by mechanical action, although increasing a pressure of the electrolyte on the sweeper 40, or a combination thereof can also be used to move the sweeper 40 away from the surface 60. Increased electrolyte pressure between the sweeper surface and the wafer surface may be achieved by pumping electrolyte through the sweeper against the wafer surface. Thus, increased pressure then causes the sweeper to hydroplane and lose physical contact with the wafer surface. As shown in FIGS. 8A-8C, it is also possible to sweep the wafer surface to establish an additive differential in a separate chamber and then electroplate material on the surface with the additive differential in a deposition chamber.

Once a differential in additive content is established by the sweeper 40 between the cavity and surface regions, this differential will start to decrease once the sweeping action is removed because additive species will start adsorbing again, trying to reach their equilibrium conditions. The embodiments described herein are best practiced using additives that allow keeping this differential as long as possible so that plating can continue preferentially into the cavity areas with minimal mechanical touching by the sweeper on the wafer surface. Additive packages containing accelerator and suppressor species and supplied by companies, such as Shipley and Enthone, allow a differential to exist as long as a few seconds. For example, using a mixture of Enthone ViaForm copper sulfate electrolyte, containing about 50 ppm of Cl, 0.5-2 mL/L of VFA Accelerator additive and 5-15 mL/L of VFS Suppressor additive, allows such a differential to exist. Other components can also be added for other purposes, such as, for example, small quantities of oxidizing species and levelers. It will be understood that the differential becomes smaller and smaller as time passes before the sweeper 40 once again restores the large differential.

Assuming that, at time t1, the differential is a fraction of the amount it was when the sweeper 40 just swept the surface area, it may be time again to bring the sweeper 40 back and establish the additive differential. If the sweeper 40 is swept over the surface of the copper layer shown in FIG. 6*b*, in addition to the new top areas 66, the tops of the bumps 65, which are rich in deposition enhancing species, will be swept. This action will reduce these deposition enhancing species on the top of the bumps, in effect achieving what the leveler additives achieve in conventional plating processes. Continuing sweeping of the surface in intervals can achieve the flat Cu deposition profile shown in FIG. 6*c*. With respect to the FIG. 6*c* profile, it is also noted that this leveling occurs because the bumps or overfills, and the trough regions therebetween, provide a similar structure as the top surface portion and cavity portion that requires plating according to these embodiments. Accordingly, by creating the additive differential between the overfills and the trough regions, plating of the trough regions occurs faster than plating of the overfills, and leveling occurs.

Figure 6B:
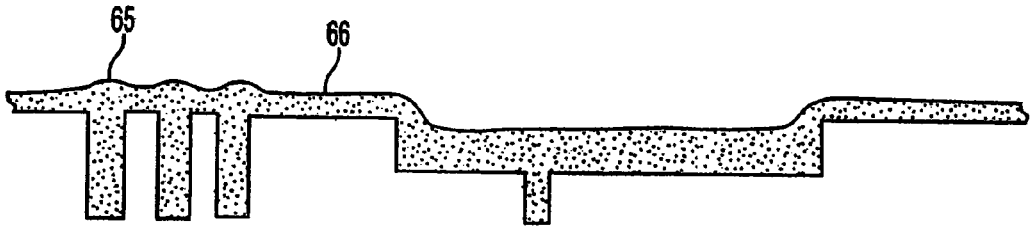
Figure 6C:
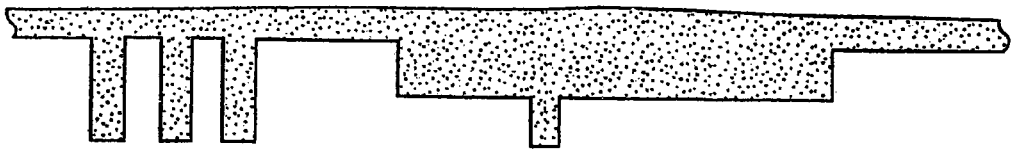

With a sweeper 40, as described above, since plating on a large portion of the wafer can occur while another small portion of the wafer is being swept, the FIG. 6*c* profile can be achieved with continuous sweeping without removing the sweeper 40 from the top surface of the wafer.

Assume that, at time t1, the additive differential between the top regions and within the features is still substantial so that conventional plating can continue over the copper structure of FIG. 6*b* without bringing back the sweeper 40. Since the enhanced current density still exists over the small features and within the large feature, by continuing conventional plating over the structure of FIG. 6*b*, one can obtain the unique structure of FIG. 6*d*, which has excess copper over the small and large features and a thin copper layer over the field areas. Such a structure may be attractive because when such a film is annealed, it will yield large grain size in the features over which there is thick copper, which results in lower resistivity interconnections and better electromigration resistance. This selective enhanced deposition is a unique feature of the described embodiments. Features with an enhanced Cu layer are also attractive for the copper removal step (electroetching, etching or CMP steps) because the unwanted Cu on the field regions can be removed before removing the excess Cu over the features. Then excess Cu over the features can be removed efficiently and planarization can be achieved without causing dishing and erosion defects. In fact, the excess Cu directly over the features may be removed efficiently by only the barrier removal step, which will be explained further below.

Figure 6D:
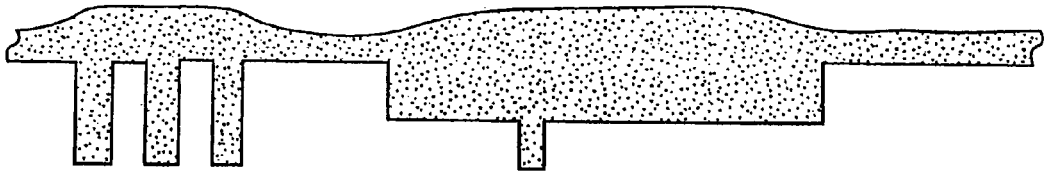
Figure 6E:
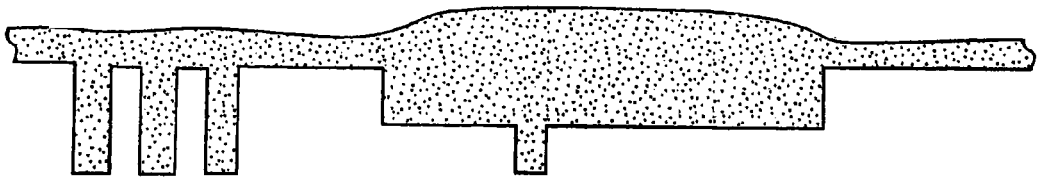
Figure 6D:
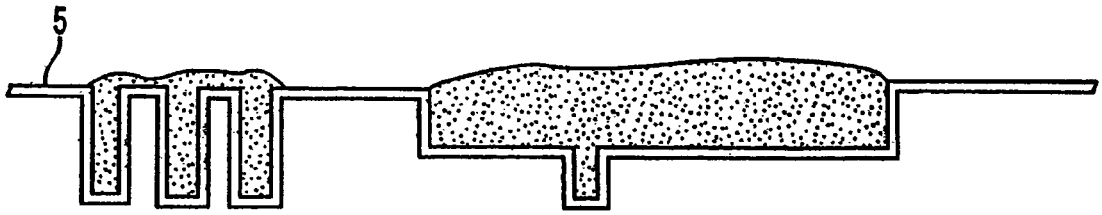
Figure 6E:
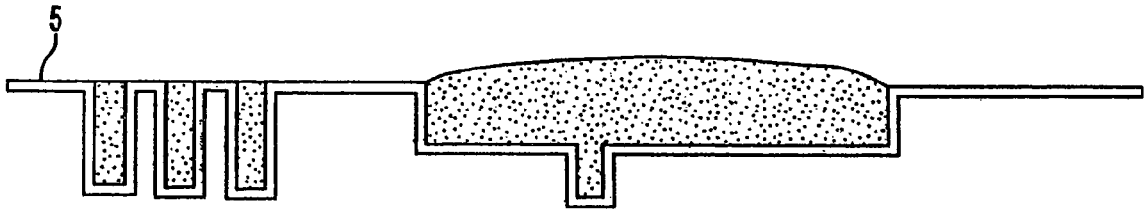

The structure in FIG. 6*e* can also be obtained using embodiment described herein. According to an embodiment, the sweeper 40 is swept over the structure of FIG. 6*b*. As explained previously, the tips of the bumps 65 in FIG. 6*b* are rich in current density enhancing or accelerating additive species. This is the reason why the bumps or overfill regions form. By sweeping the tips of the bumps 65, the deposition enhancing species near the tips of the bumps are reduced and the growth of the bumps is slowed down. In other words, the leveling action achieved chemically by use of a leveler in the electrolyte formulation can be achieved through the use of the mechanical sweeping of the embodiments described herein. After sweeping the surface and the bumps, plating is then continued with further sweeping occurring only to the extent necessary on the surface of the wafer, depending upon the characteristics of the bumps that are desired. This yields a near-flat Cu deposit over the small features and a bump or overfill over the large feature, as shown in FIG. 6*e*. It is apparent that the more sweeping action that occurs, the less pronounced the bumps will become.

It should be noted that the time periods during which the sweeper is used on the surface is a strong function of the additive kinetics, the sweeping efficiency, the plating current and the nature of the Cu layer desired. For example, if the plating current is increased, the preferential deposition into areas with additive differential may also be increased. The result then would be thicker copper layers over the features in FIGS. 6*d* and 6*e*. Similarly, using additives with kinetic properties that allow the additive differential to last longer can give more deposition of copper over the unswept features because longer deposition can be carried out after sweeping and before bringing back the sweeper. The sweeping efficiency is typically a function of the relative velocity between the sweeper surface and the workpiece surface, the pressure at which sweeping is done, and the nature of the sweeper surface, among other process related factors.

FIG. 6*dd* schematically shows the profile of the deposit in FIG. 6*d* after an etching, electroetching, CMP, or other material removal technique is used to remove most of the excess Cu from the surface. For clarity, the barrier layer 5 is also shown in this figure. As can be seen in FIG. 6*dd*, excess Cu from most of the field region is removed leaving bumps of Cu only over the features.

FIG. 6*ee* similarly shows the situation after the wafer surface depicted in FIG. 6*e* is subjected to a material removal step. In this case, there is a bump of Cu only over the large feature.

Figure 2E:
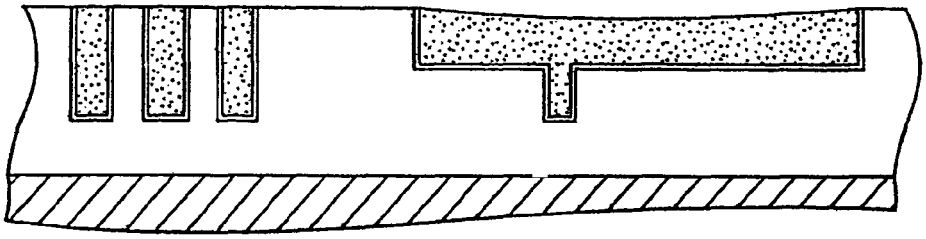
FIG. 2e (PRIOR ART)
FIG. 2E illustrates a cross-sectional view of a typical workpiece structure containing a conductor within the features.
Figure 3:
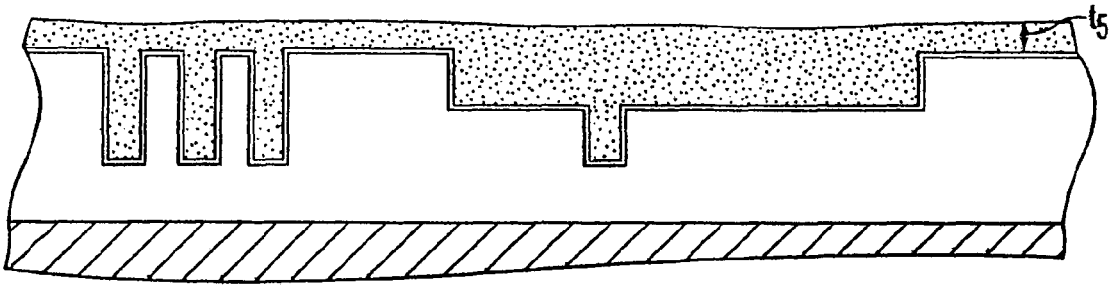
FIG. 3 illustrates a cross-sectional view of a workpiece structure obtained using electrochemical mechanical deposition.

In any case, removal of the bumps in FIGS. 6*dd* and 6*ee* and formation of a planar surface with no dishing can be achieved during the removal of the barrier layer 5 from the field regions using techniques, such as CMP. The result is the structure shown in FIG. 2*d*. Dishing, which is depicted in FIG. 2*e*, is avoided in this process because there is excess Cu in the large feature at the beginning of the barrier removal step.

It is possible to use DC, pulsed or AC power supplies for plating. Power can be controlled in many manners, including in a current controlled mode or in a voltage controlled mode, or a combination thereof. Power can be cut off to the wafer during at least some period of the plating process. Especially if cutting off power helps establish a larger additive differential, power may be cut off during a short period when the sweeper sweeps the surface of the wafer and then power may be restored and enhanced deposition into the cavities ensues. The sweeper 40 may quickly sweep the wafer surface at high pace and then be retracted for a period of time, or it may slowly move over the wafer surface while scanning a small portion at a time in a continuous manner.

Figure 7:
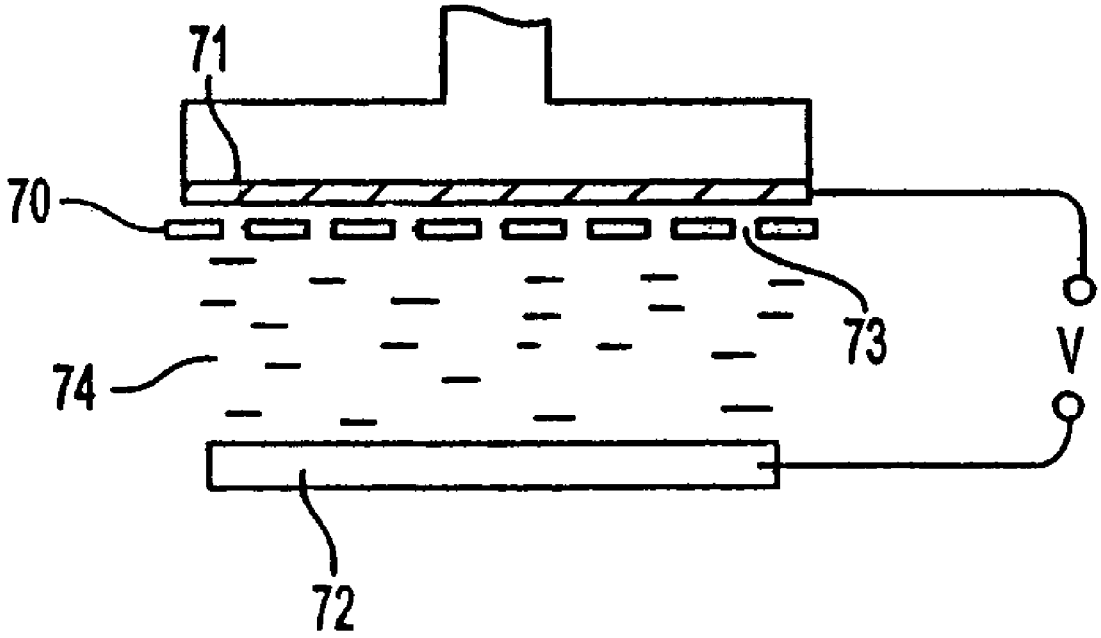
FIG. 7 illustrates a modified plating apparatus.

FIG. 7 is a sketch of an apparatus in accordance with another embodiment, which can be made not only as a new device, but also by modifying the conventional plating apparatus, such as that described above in FIG. 4. In the embodiment shown in FIG. 7, a mask 70 is disposed in close proximity of the wafer 71. A means of applying voltage V between the wafer 71 and an electrode 72 is provided. The mask 70 has at least one, and preferably many, openings 73 in it. The openings 73 are preferably designed to assure uniform deposition of copper from the electrolyte 74 onto the wafer 71 surface. In other words, in this embodiment, the surface of the mask 70 facing the wafer 71 surface is used as the sweeper and the mask 70 itself also establishes appropriate electrolyte flow and electric field flow to the wafer 71 surface for globally uniform film deposition on the surface of the wafer 71. Examples of specific masks that can be used are discussed in U.S. patent application Ser. No. 09/960,236, entitled "Mask Plate Design," filed Sep. 20, 2001, now U.S. Pat. No. 7,201,829, which claims a benefit to U.S. Provisional Application No. 60/272,791, filed Mar. 1, 2001. The foregoing application is hereby incorporated herein by reference in its entirety.

According to this embodiment, during processing, the mask 70 surface is brought into contact with the surface of the wafer 71 as the wafer 71 and/or the mask 70 are moved relative to each other. The surface of the mask 70 serves as the sweeper on the wafer 71 surface and establishes the additive differential between the surface areas and the cavity surfaces.

For example, the mask 70 and wafer 71 surfaces may be brought into contact, preferably at a pressure in the range of 0.1-2 psi, at time zero for a short period of time, preferably for a period of 2 to 20 seconds or until an additive differential is created between the top surface and the cavity surface. After creating the differential between the additives disposed on the top surface portion of the wafer 71 and the cavity surface portion of the wafer 71, as described above, the mask 70 is moved away from the wafer 71 surface, preferably at least 0.1 cm, so that plating can occur thereafter. The mask 70 is moved away from the wafer 71 surface by mechanical action, increasing a pressure of the electrolyte on the mask, or through a combination thereof. As long as the differential in additives remains, plating can then occur. The plating period is directly related to the adsorption rates of the additives and the end copper structure desired. During this time, since the mask 70 does not contact the top surface of the wafer 71, the electrolyte solution 74 then becomes disposed over the entire workpiece 71 surface, thereby allowing plating to occur. And, due to the differential, plating will occur more onto unswept regions, such as within features than on the swept surface of the wafer 71. Since the electrolyte 74 is disposed over the entire wafer 71 surface, this also assists in improving thickness uniformity of the plated layer and washing the surface of the workpiece 71 of particulates that may have been generated during sweeping.

Also, this embodiment advantageously reduces the total time of physical contact between the mask 70 and the wafer 71 and minimizes possible defects, such as scratches on the wafer 71. This embodiment may especially be useful for processing wafers with low-k dielectric layers. As is well known in the industry, low-k dielectric materials are mechanically weak compared to the more traditional dielectric films, such as SiO2. Once a sufficient additive differential no longer exists, the mask 70 can again move to contact the wafer 71 surface and create the external influence, as described above. If the mask 70 repeatedly contacts the surface of the wafer 71, continued plating will yield the Cu film shown in FIG. 6*c*.

If a profile as illustrated in FIG. 6*d* is desired using this embodiment, then, in a manner similar to that mentioned above, after a profile as illustrated by FIG. 6*b* is achieved by plating based upon an additive differential as described above, then a conventional plating, without creating a further additive differential, can be used so that the profile illustrated in FIG. 6*d* is achieved.

If a profile as illustrated in FIG. 6*e* is desired using this embodiment, then, in a manner similar to that mentioned above, after a profile as illustrated by FIG. 6*b* is achieved by plating based upon an additive differential as described above, then a combination of plating based upon an additive differential as described above, followed by conventional plating can be used so that the profile illustrated in FIG. 6*e* is achieved. This profile is obtained by using the mask to sweep the additive disposed on the bumps over the small features on the top surface of the wafer, and therefore slowing the growth of the conductor down at the bumps. Accordingly, once the mask is moved away from the wafer surface, growth continues more rapidly over the large features whose inside surfaces had not been swept by the mask action. While the FIG. 5 embodiment described above is described using a sweeper, and the FIG. 7 embodiment is described above using a mask, it is understood that the two mechanisms, both being workpiece-surface-influencing devices, can be used interchangeably, with our without a shaping plate.

There are other possible interactive additive combinations that can be utilized and other additive species that may be included in the plating bath formulation. The embodiments described herein are not meant to be limited to the exemplary interactive additive combinations cited herein, but rather include any combination that establishes a differential between the additives on the swept and the unswept surfaces of the wafer. This differential is such that it causes more material deposition onto the unswept regions (in terms of per unit area) than the swept regions. This means the plating current density is higher on unswept surfaces than on swept surfaces. The sweeper 40 in FIG. 6*a* is preferably flat and large enough so that it does not go or sag into and sweep the inside surface of the larger features on the wafer.

The above-described process may be implemented in systems or tools of that are configured to first establish the above-described additive differential on a workpiece surface using an external influence and then to electrodeposit a conductor onto the workpiece surface. Both steps of the process may be performed in the same process chamber or in different process chambers. FIGS. 8A-8C show an exemplary system 100, including a first process chamber 102 for establishing an additive differential on a surface 101 of a wafer W and a second process chamber 104 for conducting a deposition process on the surface 101. In the system 100, the first process chamber 102 or the auxiliary chamber is located over the second chamber 104 or the plating chamber. Systems having such vertically configured process chambers are described in U.S. patent application Ser. No. 09/466,014, now U.S. Pat. No. 6,352,623 assigned to assignee of the present application and hereby incorporated herein by reference in its entirety. There may be separators 106 between the two chambers 102, 104 for avoiding seepage of any solutions used in the auxiliary chamber 102 into the plating chamber 104. The auxiliary chamber 102 includes additive differential forming means, such as a workpiece-surface-influencing device and applicators or additive applicators. The auxiliary chamber 102 preferably includes a number of applicators, such as fluid nozzles 109 placed on the separators 106 or on the walls of the auxiliary chamber 102. These nozzles 109 are used to apply additives onto the surface 101 of the wafer W in liquid or gas phases. For example, a solution including additives may be delivered to the surface 101 in streams or sprays depicted as arrows A in FIG. 8A. However, some of the nozzles 109 can be conveniently used to apply a cleaning or rinsing solution, such as de-ionized water, on the wafer W before and/or after the plating process.

The auxiliary chamber 102 preferably also comprises a sweeper 108, which may have any one of the sweeper designs described herein. The sweeper 108 is a workpiece-surface-influencing device, which may also be a pad and/or a mask, as described above. It may or may not have porosity or openings in it. In FIG. 8C, the sweeper 108 is shown in a passive position, stowed adjacent a wall of the auxiliary chamber 102, and in FIG. 8B, the sweeper is shown in an active position, sweeping the surface 101 of the wafer W. Although in FIGS. 8A-8C, the sweeper 108 is attached to a wall of the auxiliary process chamber 102 with an arm 110 or brace, the sweeper 108 may be mounted in the system 100 in various other ways, including on at least one of the separators 106. What is important is that the sweeper 108 is preferably placed in a way that allows complete sweeping of the surface 101 of wafer W when a relative motion is established between the surface 101 and the sweeper 108. Means of establishing such relative motion have already been discussed, especially with reference to FIGS. 5, 5*a*-5*d*2.

Referring to FIGS. 8A-8C, the plating chamber 104 preferably includes plating means, such as a deposition unit 112, which may be an electrochemical deposition process unit including a process solution 114 and an electrode 116 immersed in the process solution 114. FIGS. 8A-8C are simplified sketches of an electrodeposition unit. An actual unit may have other components, such as a filter over the electrode, means to flow the electrolyte in and out of the unit, etc. The deposition unit 112 may also be similar to the one shown in FIG. 4. A polishing pad 118 or a workpiece-surface-influencing device (shown in dotted lines), which may be porous or with openings may be attached on the top section of the deposition unit 112. The process solution 114 may be an electrodeposition electrolyte, such as the copper sulfate based solution described above. In the system 100, the wafer W is held by a wafer carrier 120 while the surface 101 is processed either in the auxiliary chamber 102 or in the plating chamber 104. A moving mechanism (not shown) of the wafer carrier 120 may rotate and laterally move the wafer W during these processes. The wafer carrier 120 is attached to the moving mechanism by an extendible shaft 122, which can be extended. The extendible shaft 122 allows wafer W to be processed in the auxiliary chamber 102 when the wafer carrier 120 is in a retracted position and when the separators 106 are in a closed position, as shown in FIGS. 8A and 8B. The extendible shaft 122 further allows the wafer W to be processed in the plating chamber 104 when the wafer carrier 120 is in an extended position and the separators 106 are open, as shown in FIG. 8C. The carrier 120 may have contact means, such as electrical contacts, conductive fingers, brushes, rollers, to make electrical contact to the surface 101 of the wafer W. Alternatively, contact means may be placed in the plating chamber 104 and the electrical contact with the surface 101 of the wafer W is achieved when the wafer carrier 120 is in an extended position.

In the following section, an exemplary process sequence using the system 100 will be described with reference to FIGS. 8A-8C, and the corresponding changes on the surface of the wafer when such process steps are applied will be shown with reference to FIGS. 9A-9D. FIGS. 9A-9D illustrate an exemplary surface portion 200 of the wafer W including a feature 202 or cavity, such as a large via or trench, with a depth-to-width ratio of less than one, surrounded by a surface region 204 or as often called a field region, which is an exemplary part of the surface 101 of the wafer W shown in FIGS. 8A-8C. The surface portion 200 may be a part of a dielectric layer and may be coated with a conductive layer (not shown), often a bi-layer containing a barrier layer, which is deposited on the exposed surfaces of the dielectric layer and a seed layer, which is deposited on the barrier layer. The barrier layer may be a Ta or TaN layer, and the seed layer is preferably a thin metal layer, such as, for example, a copper seed layer for copper electrodeposition applications. Alternatively, the conductive layer on the wafer surface 101 may be a pre-formed conductive layer and the cavity or feature 202 may be a cavity in the pre-formed conductive layer. The pre-formed conductive layer may be obtained by electrodepositing or electroless depositing a conductive material, such as copper on the wafer surface 101. Such layers may be formed during a predetermined stage of a wet deposition process. FIGS. 6*a*-6*b* show such partially coated layers.

Figure 9A:
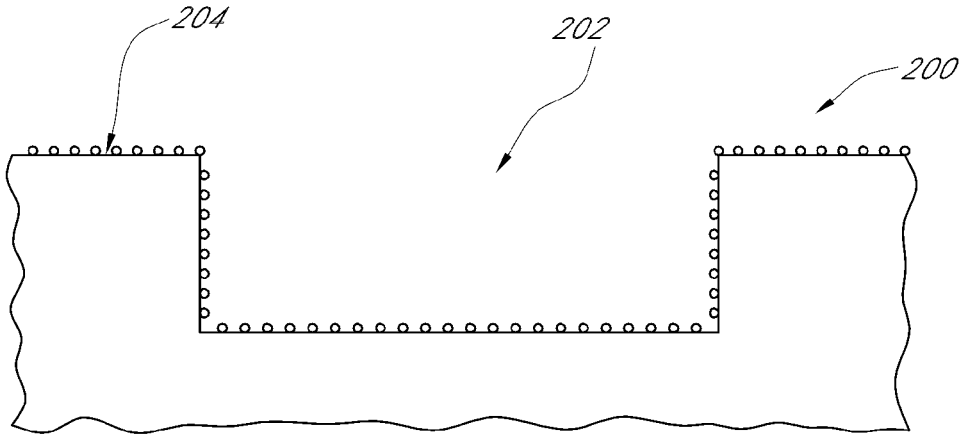
FIGS. 9A-9D illustrate a substrate processed using the system of the present invention shown in FIGS. 8A-8C.

Referring to FIG. 8A, in a first process step, as the wafer W is rotated on the wafer carrier 120, a solution comprising at least one additive is delivered onto the surface 101 of the wafer W in the auxiliary chamber 102. Correspondingly, as shown in FIG. 9A, additives or additive molecules, depicted as small circles, in the solution are attached to, or adsorbed on the walls of the feature 202 and the surface region 204 of the wafer surface 101. At this stage of the process, additive concentrations on the surface of the feature 202 and on the surface region 204 are substantially the same. The solution may contain accelerators and/or suppressors and/or levelers. The solution may also comprise inorganic additives, such as Cl ions, other anions and/or cations, buffers, etc. The pH of the solution may be neutral, acidic, or basic. The solution may be aqueous or it may comprise organic solvents. In the case of processing copper layers, the solution may also be a copper plating solution, such as a commonly used copper sulfate-based acidic solution. In this embodiment, the solution preferably comprises an accelerator additive and it is preferably an aqueous solution. During the process, the surface 101 is preferably soaked with the solution for about 5-200 seconds, and more preferably about 10-60 seconds. The wafer W is preferably rotated at 1-100 rpm, and more preferably at 5-50 rpm during the application of the accelerators. It should be noted that the process step that causes additive adsorption on the wafer surface 101 may be carried out by various other ways, including, for example, soaking the wafer surface 101 in a container filled with a solution comprising the desired additive. One exemplary composition of an additive containing solution is a water and SPS solution where SPS content may be 1-1000 ppm. Alternately, an aqueous solution with 1-10 mL/L of commercially available Enthone VFA Accelerator may be employed.

Figure 9B:
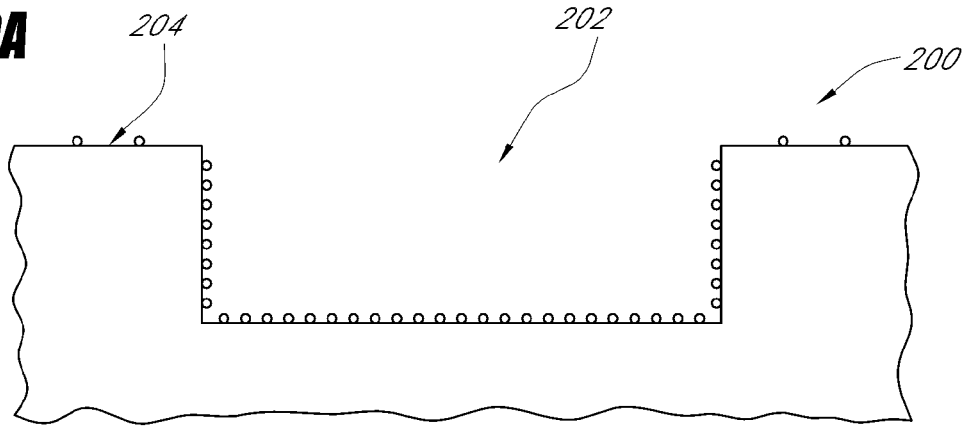

Referring to FIG. 8B, in a second process step, an additive differential, which is an accelerator differential in this illustrated embodiment, is established by sweeping the surface 101 with the sweeper 108 as the wafer W is still being held by the wafer carrier 120. Although the sweeping action is preferably conducted after stopping the delivery of the additive solution to the surface 101, it is also possible to sweep the surface 101 as the additive solution is delivered to the surface 101. Additive surface concentration differential between additives adsorbed on the walls within the feature and the additives adsorbed on the surface is shown in FIG. 9B. The sweeping action, described in connection with FIG. 8B, removes a significant amount of the additives from the surface region 204 or such sweeping action does not allow efficient adsorption of the additive on the swept surface, leaving a reduced amount of additives distributed across the surface region 204. As shown in FIG. 9B, in comparison to the additive concentration on the internal feature surfaces, the sweeping action greatly reduces the concentration of the additive molecules on the surface region 204, which is an exemplary part of the surface 101 of the wafer W. In the case of an accelerator additive, deposition of the conductive material into the feature is enhanced compared to deposition onto the surface region, due to the higher additive concentration within the feature during the next process step, which is an electrodeposition step. The sweeping action is preferably generated by establishing a relative motion between the surface 101 and the sweeper 106. The pressure applied onto the wafer surface 101 during sweeping is preferably in the range of 0.1-2 psi. As the surface 101 rotated, the sweeper 106 may move, for example, like a windshield wiper of a car on the surface of the wiper, or move in different motions (as described above), or be just stationary.

Once the additive differential is created on the surface 101, the sweeping action preferably is stopped and the sweeper 108 is stowed, the separators 106 are opened and the wafer carrier 120 is extended into the plating chamber 104 from the auxiliary chamber 102 to perform a deposition process step, as shown in FIG. 8C. It should be noted that the wafer W may be spin dried in the auxiliary chamber 102 before it is lowered into the plating chamber 104. Alternatively, the wafer W may be rinsed first in the auxiliary chamber 102 and then dried before it is lowered into the plating chamber 104. For additives that are not easily desorbed from surfaces, such as accelerators, such rinsing and drying steps do not disturb the already established additive concentration gradient shown in FIG. 9B. For additives that can be desorbed easily from the wafer surface 101, such rinsing process steps may be omitted.

As shown in FIG. 8C, in the next step of the process a conductive material, which is copper in this embodiment, is electrodeposited on the surface 101 of the wafer W from the electrolyte as the electrolyte is delivered on the surface 101 and a potential difference is established between the surface 101 and the electrode 116. The electrolyte may not contain any additives or may contain at least one additive. If the electrolyte does not contain an additive, the process sequence continues with filling the feature with a conductive layer, using electroplating, as described below in connection with FIG. 9D.

Figure 9C:
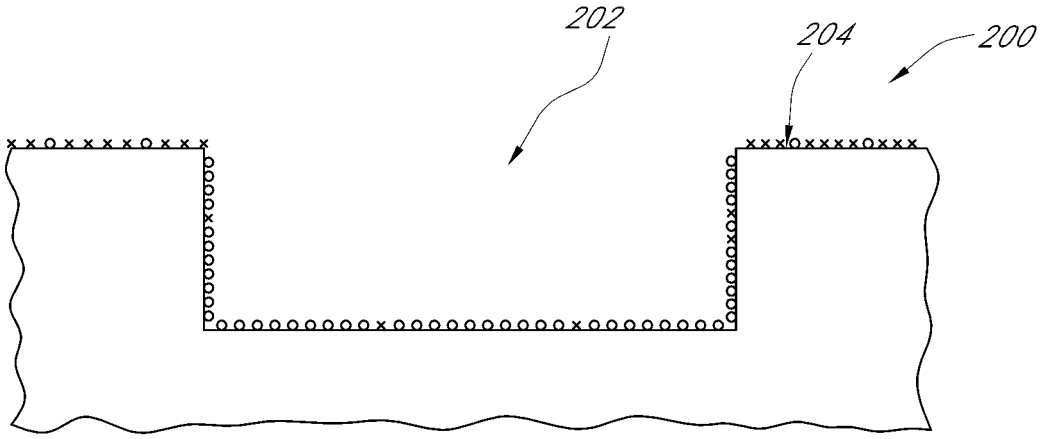

However, as described below the electroplating may be performed with an electrolyte containing an additive. If the additive adsorbed on the surface portion (see FIGS. 9A and 9B) is an accelerator, then the electrolyte preferably includes at least a suppressor, as described below in connection with FIG. 9C. FIG. 9C illustrates the case of exposing the surface portion 200 shown in FIG. 9B to an electrolyte, including suppressors or suppressor molecules, during the plating process. As described above in connection with FIG. 9B, the surface region 204 had been swept with a sweeper, which significantly reduced the surface concentration or number of additive molecules per unit area across the surface region 204. Referring to FIG. 9C, as the wafer is contacted with the electrolyte having the suppressors, suppressor molecules start to adsorb on the surface region 204 and fill the available surface sites from which the majority of the accelerators were cleared by the sweeping action of the sweeper. Suppressors or suppressor molecules adsorbed on the surface region 204 and in the feature are depicted with small 'x' signs. Since the internal surfaces of the feature 202 are already heavily populated by adsorbed accelerators, there is a very limited space to accommodate suppressor molecules on the surfaces of the feature 202. This slows down the kinetics of suppressor adsorption onto the internal surfaces of the feature 202 because desorbing the already adsorbed accelerators from such surfaces and replacing them with suppressor molecules is a slow process. Therefore, even though the suppressors are in the plating environment, they cannot switch sites with the accelerators and be quickly adsorbed on the surfaces occupied by the accelerators. They, however, can adsorb very quickly onto the swept and activated surface region. Consequently, the accelerator-to-suppressor ratio is small on the surface region 204 and much larger within the feature 202, as shown in FIG. 9C. This means a much higher deposition rate going into the feature compared to onto the surface region once electrodeposition initiates. For example, suppressor molecules may adsorb on swept surfaces within time periods in the range of 0.001-1 second, whereas it may take them 0.1-1000 seconds to be adsorbed on surfaces with a high population of accelerators. These values, of course, are strong functions of the chemicals used as accelerators and suppressors. Commonly used accelerators include chemicals such as SPS, bis(sodiumsulfopropyl)disulfide, and commonly used suppressors include, for example, polyethylene glycol (PEG) related polymers.

Figure 9D:
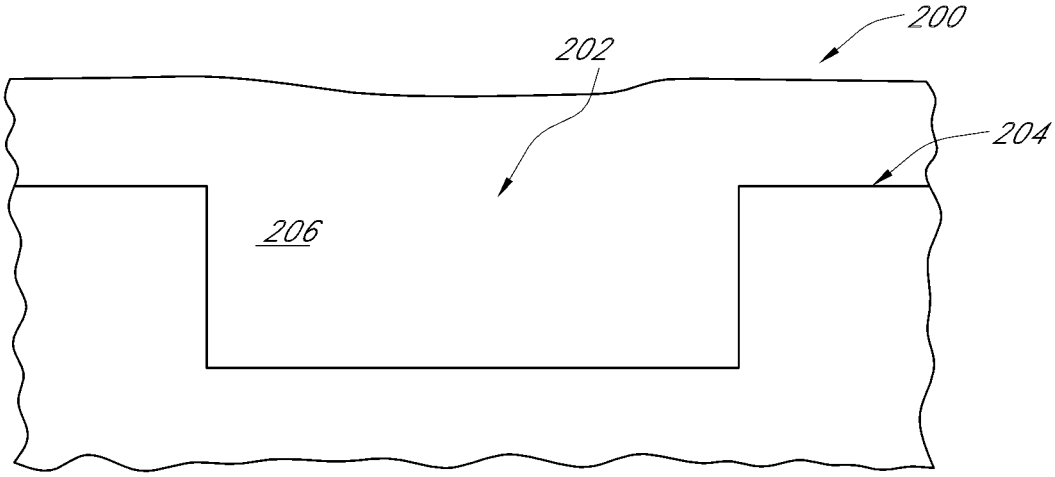

As shown in FIG. 9D, an electrodeposition process with enhanced copper deposition into the feature 202 results in a copper layer 206 filling the feature 202 and extending on the surface region 204. The copper layer 206 is preferably thin over the surface region 204 and fills the cavity 202 because of the higher rate of deposition into the feature 202 and a reduced rate of deposition onto the surface region 204. This is because of the accelerator differential present on the surface portion 200 shown in FIG. 9B. Accordingly, as long as an additive differential exists, copper continues to deposit into the feature 202 at a higher rate (typically 1.5-10 times) than it deposits on the surface region 204. In this application, the additive differential refers to accelerator differential, or suppressor differential, or both. In an alternative plating embodiment, the plating process may be performed in more than one step or using multiple plating steps by partially filling the feature and then retracting the wafer into the auxiliary chamber and establishing an accelerator differential on the partially plated wafer. The wafer then is extended into the plating chamber and plated. These steps may be repeated several times during the plating process, i.e., after partial plating as the additive differential starts reducing, the wafer may be taken into the auxiliary chamber for re-establishing the differential.

Alternatively, to keep the additive differential high during plating, a polishing pad 118 or a workpiece-surface-influencing device may be applied on the surface 101 during plating and it performs an additional sweeping to extend the time span that the additive differential exists on the surface 101.

Using the multi-step process approaches involving an auxiliary chamber and a process chamber, it is possible to obtain the unique conductor layer structures shown in FIGS. 6*d* and 6*e*. The important considerations and processing steps to obtain such structures have already been discussed and will not be repeated here.

After completing the electroplating process, in a fourth process step, the wafer held by the wafer carrier 120 is preferably retracted into the auxiliary chamber 102 and the separators are closed. A cleaning solution, such as DI water (deionized water), is applied onto the wafer W from some of the nozzles 109 to rinse or clean the wafer W and the copper layer 206. After rinsing, the wafer W is spin-dried by rotating the wafer carrier 120, preferably at a high speed. It will be appreciated that each step of the process is preferably performed while the wafer W is held by the same wafer carrier 120, which eliminates time losses and contamination problems, which may result if the wafer W is transferred by switching carrier heads. Although it is possible to practice this embodiment by transferring the wafer W from one carrier to another, using only one carrier increases process yield and minimizes contamination problems. Further, the process may be performed using chambers integrated horizontally by placing an auxiliary chamber next to a plating chamber. In this horizontal arrangement of the chambers, a wafer may be processed on the same carrier head in both chambers or on different carrier heads by transferring the wafer from an auxiliary chamber carrier head to a plating chamber carrier head.

Along with using copper and its alloys as the conductive material, many other conductive materials, such as gold, iron, nickel, chromium, indium, lead, tin, lead-tin alloys, non-leaded solderable alloys, silver, zinc, cadmium, ruthenium, their respective alloys may be used in these embodiments. The embodiments described herein are especially suited for the applications of high performance chip interconnects, packaging, magnetics, flat panels and opto-electronics.

In another embodiment, and of particular usefulness when using a mask or a sweeper for sweeping, it is recognized that the plating current can affect adsorption characteristics of additives. For some additives, adsorption is stronger on surfaces through which an electrical current passes. In such cases, adsorbing species may be more easily removed from the surface they were attached to after electrical current is cut off or reduced from that surface. Loosely bound additives can then be removed easily by the mask or the sweeper. In the cavities, although loosely bound, additives can stay more easily because they are not influenced by the external influence (i.e., mask nor sweeper). Once the mask or the sweeper is used to remove loosely bound additives with power cut off, the mask or the sweeper can be removed from the surface of the wafer, and power then applied to obtain plating, with the additive differential existing. This way, sweeping time may be reduced, thereby minimizing physical contact between the sweeper and the wafer surface.

In the previous descriptions, numerous specific details are set forth, such as specific materials, mask designs, pressures, chemicals, processes, etc., to provide a thorough understanding. However, as one having ordinary skill in the art would recognize, the embodiments described herein can be practiced without resorting to the details specifically set forth.

Although various preferred embodiments have been described in detail above, those skilled in the art will readily appreciate that many modifications of the exemplary embodiments are possible without materially departing from the novel teachings and advantages of these embodiments. It will be appreciated, therefore, that in some instances, some features of the embodiments described herein will be employed without a corresponding use of other features without departing from the spirit and scope of the invention as set forth in the appended claims.

What is claimed is:

1. A method of electrodepositing a conductive material onto a surface of a wafer, wherein the surface includes a surface portion and a cavity portion, the method comprising:

establishing a differential in an adsorbed concentration of an additive between the surface portion and the cavity portion of the surface in a first chamber;

transporting the wafer to a second chamber after establishing the differential; and electrodepositing the conductive material to form a conductive layer on the surface having the differential in the second chamber.

2. The method of claim 1, wherein establishing a differential includes sweeping the surface with a sweeper.

3. The method of claim 2, wherein the additive comprises an accelerator.

4. The method of claim 2, wherein the sweeper includes a pad configured to touch the surface of the wafer while the differential is being established.

5. The method of claim 1, further including applying the additive to the surface of the wafer at least one of before and during establishing the differential.

6. The method of claim 5, wherein applying comprises injecting the additive towards the surface using nozzles.

7. The method of claim 6, wherein the additive comprises an accelerator.

8. The method of claim 1, further including holding the wafer by a wafer carrier.

9. The method of claim 8, wherein transporting is performed with the wafer carrier.

10. The method of claim 8, wherein transporting is performed with another wafer carrier.

11. The method of claim 1, wherein electrodepositing is performed in the second chamber comprising a plating unit with an electrode and a plating solution.

12. The method of claim 11, wherein the plating solution includes suppressor additives.

13. The method of claim 12, further including sweeping the surface with another sweeper in the second chamber.

14. The method of claim 1, wherein establishing the differential, transporting the wafer and electrodepositing the conductive material are carried out while the wafer is held by a wafer carrier.

15. The method of claim 1, further including rinsing the wafer after establishing the differential.

16. The method of claim 15, further including drying the wafer after rinsing.

17. The method of claim 16, wherein rinsing and drying are performed in the first chamber.

18. The method of claim 1, further including cleaning the wafer after electrodepositing.

19. The method of claim 18, wherein cleaning is carried out in the first chamber.

20. The method of claim 1, wherein the conductive material is copper.

21. The method of claim 2, wherein sweeping the surface comprises applying a pressure onto the surface with the sweeper, the pressure between about 0.1 psi and about 2 psi.

22. The method of claim 9, wherein transporting the wafer comprises moving the wafer carrier horizontally between the first chamber and the second chamber.

23. The method of claim 9, wherein transporting the wafer comprises moving the wafer carrier vertically between the first chamber and the second chamber.

24. The method of claim 18, wherein rinsing is carried out in the first chamber.

25. The method of claim 1, wherein establishing a differential comprises not applying power to the surface in the first chamber.

26. The method of claim 1, further comprising:

before establishing the differential, applying power to the surface;

during establishing the differential, not applying power to the surface; and after establishing the differential, applying power to the surface.

27. The method of claim 1, further comprising, after establishing the differential, applying power to the surface.

28. The method of claim 1, wherein establishing the differential comprises soaking the surface with a solution comprising the additive.

29. The method of claim 28, wherein soaking the surface is for a duration of between about 5 seconds and about 200 seconds.

30. The method of claim 28, wherein soaking the surface is for a duration of between about 10 seconds and about 60 seconds.

31. The method of claim 28, wherein soaking the surface comprises rotating the wafer between 1 rpm and 100 rpm.

32. The method of claim 28, wherein soaking the surface comprises rotating the wafer between 5 rpm and 50 rpm.

33. The method of claim 1, wherein the electrodepositing comprises plating from a solution substantially free of additives.

34. The method of claim 1, wherein the electrodepositing comprises plating from a solution comprising a second additive different from the additive.

35. The method of claim 34, wherein the additive comprises an accelerator.

36. The method of claim 35, wherein the second additive comprises a suppressor.

37. The method of claim 34, wherein the second additive comprises a suppressor.

38. The method of claim 1, wherein the electrodepositing comprises plating from a solution comprising a suppressor.

39. The method of claim 1, after electrodepositing the conductive material, the conductive material over the cavity portion is thicker than the conductive material over the surface portion.

40. The method of claim 39, wherein the cavity portion of the surface comprises a large cavity.

41. The method of claim 40, wherein the cavity portion of the surface further comprises small cavities.

42. The method of claim 41, wherein the conductive material over the large cavity is thicker than the conductive material over the small cavities.

* * * * *